US012595085B2

(12) United States Patent
Kurokawa

(10) Patent No.: US 12,595,085 B2
(45) Date of Patent: Apr. 7, 2026

(54) BOX-PACKING APPARATUS

(71) Applicant: ISHIDA CO., LTD., Kyoto (JP)

(72) Inventor: Masashi Kurokawa, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 18/948,344

(22) Filed: Nov. 14, 2024

(65) Prior Publication Data

US 2025/0162746 A1 May 22, 2025

(30) Foreign Application Priority Data

Nov. 17, 2023 (JP) ..... 2023-195919

(51) Int. Cl.
*B65B 57/14* (2006.01)
*B65B 35/44* (2006.01)

(52) U.S. Cl.
CPC ..... *B65B 35/44* (2013.01); *B65B 57/14* (2013.01)

(58) Field of Classification Search
USPC ..... 53/443
See application file for complete search history.

(56) References Cited

U.S. PATENT DOCUMENTS 4,864,801 A * 9/1989 Fallas ..... B65B 39/007 53/448
5,778,640 A * 7/1998 Prakken ..... B65B 5/061 53/538
2004/0084468 A1 5/2004 Kelbert et al.
2011/0232228 A1 9/2011 Iwasa et al.

FOREIGN PATENT DOCUMENTS

FR 1484885 A 6/1967
JP 1994003806 U 1/1994

OTHER PUBLICATIONS

Extended European Search Report issued in corresponding European Application No. 24211012.0, dated May 8, 2025.

* cited by examiner

*Primary Examiner* — Chinyere J Rushing-Tucker
(74) *Attorney, Agent, or Firm* — United IP Counselors, LLC

(57) ABSTRACT

The disclosed box-packing apparatus can pack a large quantity of articles quickly and orderly. It includes a conveyance unit, an alignment unit, a transfer unit, a contact unit, a drive unit, and a control unit. The alignment unit aligns articles conveyed on the conveyance unite so that mutually adjacent ones partially overlap and form an article group. The transfer unit transfers article groups to a box-packing conveyance route. The contact unit contacts articles on the box-packing conveyance route starting-end side in the transferred article group. The drive unit drives the contact unit under control of the control unit, to move the contact unit in the alignment direction of the article group while the contact unit is contacting and supporting the articles on the box-packing conveyance route and increase the angle formed by a contact surface of the contact unit and a horizontal plane after the contact unit starts moving.

9 Claims, 21 Drawing Sheets

BOX-PACKING APPARATUS

BACKGROUND

Technical Field

This disclosure relates to a box-packing apparatus.

Related Art

Patent document JP-U No. H6-3806 discloses a box-packing apparatus (an automated snack food packing apparatus) that drops, into a box conveyed directly under the terminal end portion of a supply conveyor, articles (packaged snack food) that are sequentially supplied by the supply conveyor.

SUMMARY

Box-packing apparatuses like the one disclosed in JP-U No. H6-3806 have the problem that work time becomes longer in the case of a large quantity of articles. Therefore, it is an object of box-packing apparatuses in accordance with the present disclosure to provide a box-packing apparatus that can pack a large quantity of articles in a short amount of time and in an ordered state.

Thus, a box-packing apparatus of a first aspect includes a conveyance unit, an alignment unit, a transfer unit, a contact unit, a drive unit, and a control unit. The conveyance unit conveys plural articles from outside. The alignment unit aligns the conveyed articles so that the articles that are mutually adjacent partially overlap to thereby form an article group. The transfer unit transfers the aligned article group to a box-packing conveyance route. The contact unit contacts the articles that are on the box-packing conveyance route starting end side in the transferred article group. The drive unit drives the contact unit. The control unit controls the drive unit to move the contact unit in the alignment direction of the article group in a state in which the contact unit is contacting and supporting the articles that are on the box-packing conveyance route starting end side and changes an angle formed by a contact surface of the contact unit and a horizontal plane from a first angle to a second angle larger than the first angle after the contact unit starts moving.

In this box-packing apparatus, a large quantity of articles can be packed in a short period of time and in an ordered state.

A box-packing apparatus of a second aspect is the box-packing apparatus of the first aspect, wherein the control unit changes the angle formed by the contact surface of the contact unit and a horizontal plane from the first angle to the second angle from when it starts moving the contact unit to until it finishes moving the contact unit.

A box-packing apparatus of a third aspect is the box-packing apparatus of the first aspect, wherein the control unit changes the angle formed by the contact surface of the contact unit and a horizontal plane from the first angle to the second angle after it finishes moving the contact unit.

A box-packing apparatus of a fourth aspect is the box-packing apparatus of the first aspect, wherein the control unit changes the angle formed by the contact surface of the contact unit and a horizontal plane from the first angle to the second angle after a predetermined amount of time after it finishes moving the contact unit.

A box-packing apparatus of a fifth aspect is the box-packing apparatus of any of the first aspect to the fourth aspect, wherein the transfer unit laterally moves the article group in a direction perpendicular to the conveyance direction while maintaining its aligned state.

A box-packing apparatus of a sixth aspect is the box-packing apparatus of any of the first aspect to the fifth aspect, wherein the alignment unit and the conveyance unit are each disposed in a plural number.

A box-packing apparatus of a seventh aspect is the box-packing apparatus of any of the first aspect to the sixth aspect, wherein the transfer unit includes an accumulation unit. The accumulation unit accumulates a plurality of the article groups such that they are parallel to each other on the box-packing conveyance route. The accumulation unit has a bottom portion and two inclined surfaces. The two inclined surfaces are disposed on both sides of the bottom portion as viewed from the front and rise upward from the bottom portion while inclining away from each other in directions away from the bottom portion.

DETAILED DESCRIPTION

An exemplary embodiment of a box-packing apparatus in accordance with the claimed invention will be described below with reference to the drawings. It will be noted that in the description of the drawings identical elements are assigned identical reference signs and redundant description will be omitted. In the following description, the directions of front/rear, upper/lower, and left/right relative to a box-packing apparatus are used for the sake of conveyance. In several of the drawings, orthogonal axes representing these directions are shown. The front and rear direction and the left and right direction are both horizontally extending directions. The up and down direction is equivalent to the vertical direction. Furthermore, there are cases where expressions such as the same, horizontal, and parallel are used, and these include not only cases where that which the expressions describe are completely the same, horizontal, or parallel but also cases where they are substantially the same, horizontal, or parallel.

(1) Overall Configuration

Figure 1:
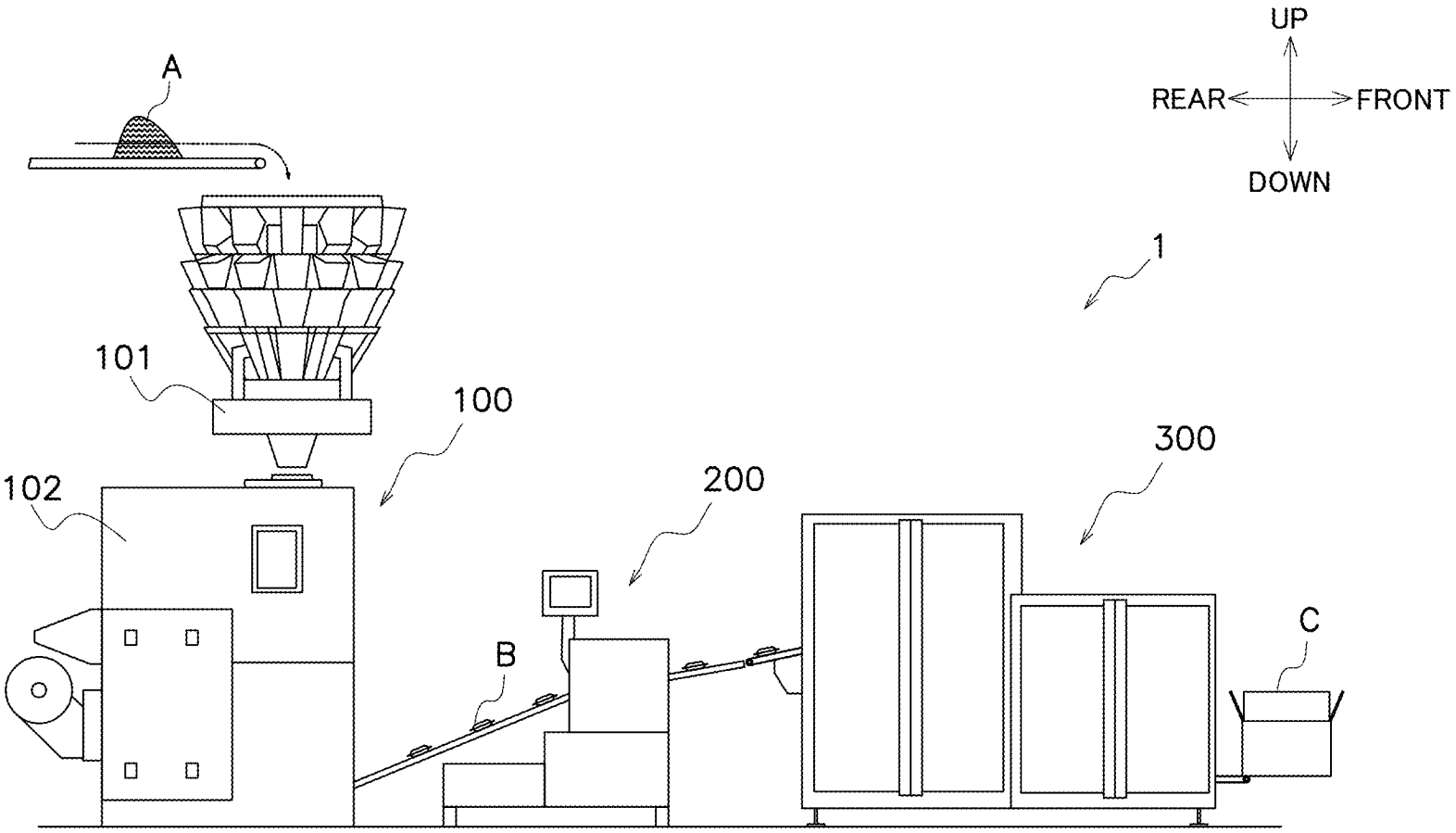
FIG. 1 is a schematic elevation view of an embodiment of a packaging and box-packing line, which includes a box-packing apparatus in accordance with the claimed invention.

FIG. 1 illustrates an exemplary packaging and box-packing line 1 including a box-packing apparatus 300. The packaging and box-packing line 1 has a packaging machine 100, an inspection apparatus 200, and the box-packing apparatus 300. It will be noted that FIG. 1 shows the box-packing apparatus 300 covered by a cover.

The packaging machine 100 packages, a predetermined quantity at a time in a packaging material, a product A manufactured by a manufacturing apparatus (not shown in the drawings). Articles that are obtained by packaging the product A in the packaging material will hereinafter be called bags B. The packaging machine 100 has a combination weighing machine 101 and a bagmaking-and-packaging machine 102. The combination weighing machine 101 is disposed above the bagmaking-and-packaging machine 102. The combination weighing machine 101 weighs a quantity of the product A to be put into one bag B and drops the product A to the bagmaking-and-packaging machine 102. The bagmaking-and-packaging machine 102 may be a vertical pillow bagmaking-and-packaging machine, packages in bags B (vertical pillow bags) the product A weighed by the combination weighing machine 101, and supplies the bags B to the inspection apparatus 200. Although this is not intended to be limiting, the product A is, for example, a snack food.

The inspection apparatus 200 inspects the weights of, and whether or not there are pinholes and/or foreign matter in, the bags B supplied from the packaging machine 100 and supplies the bags B to the box-packing apparatus 300.

Figure 2:
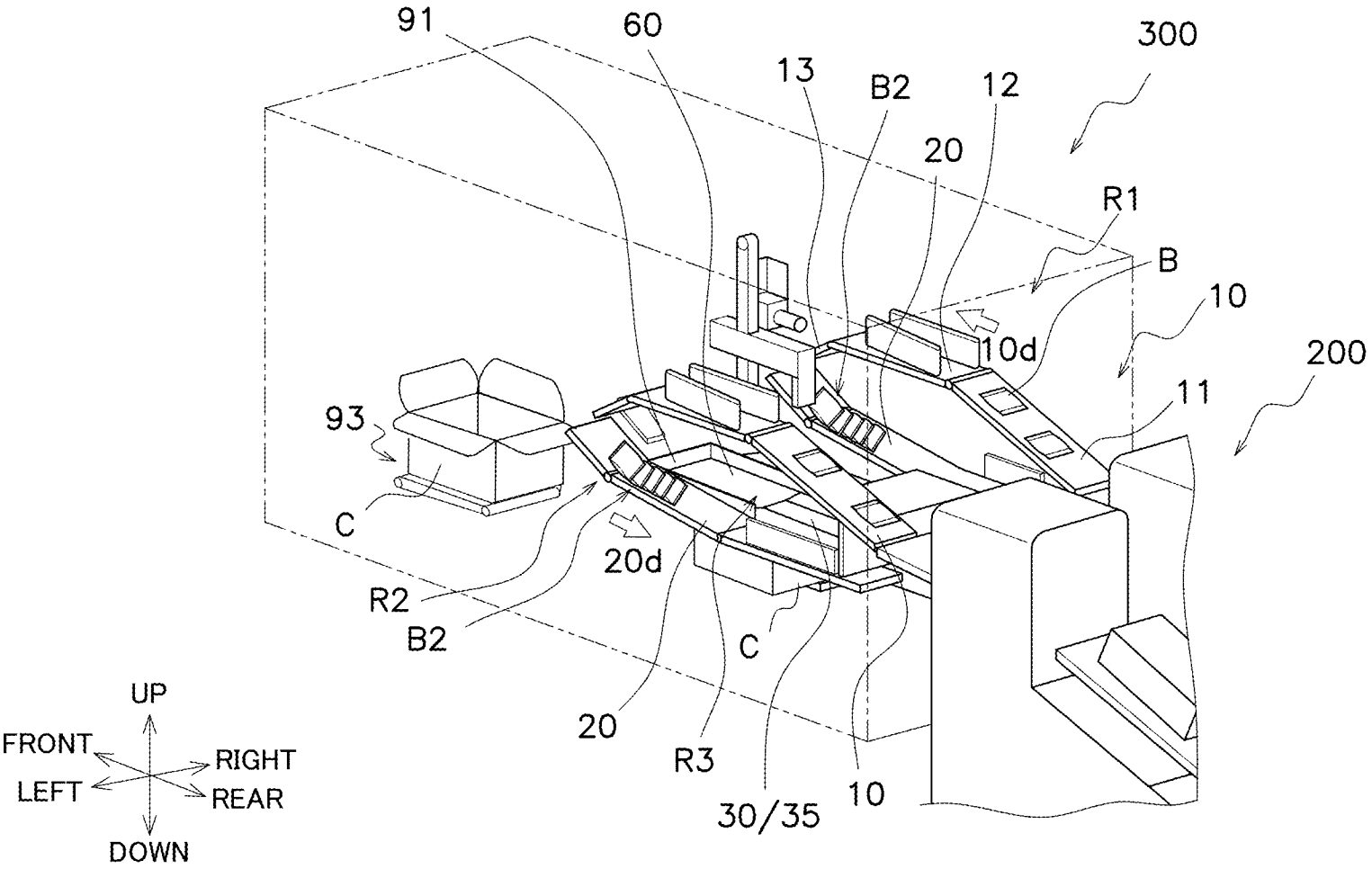
FIG. 2 is a perspective view of the box-packing apparatus illustrated in FIG. 1.
Figure 9:
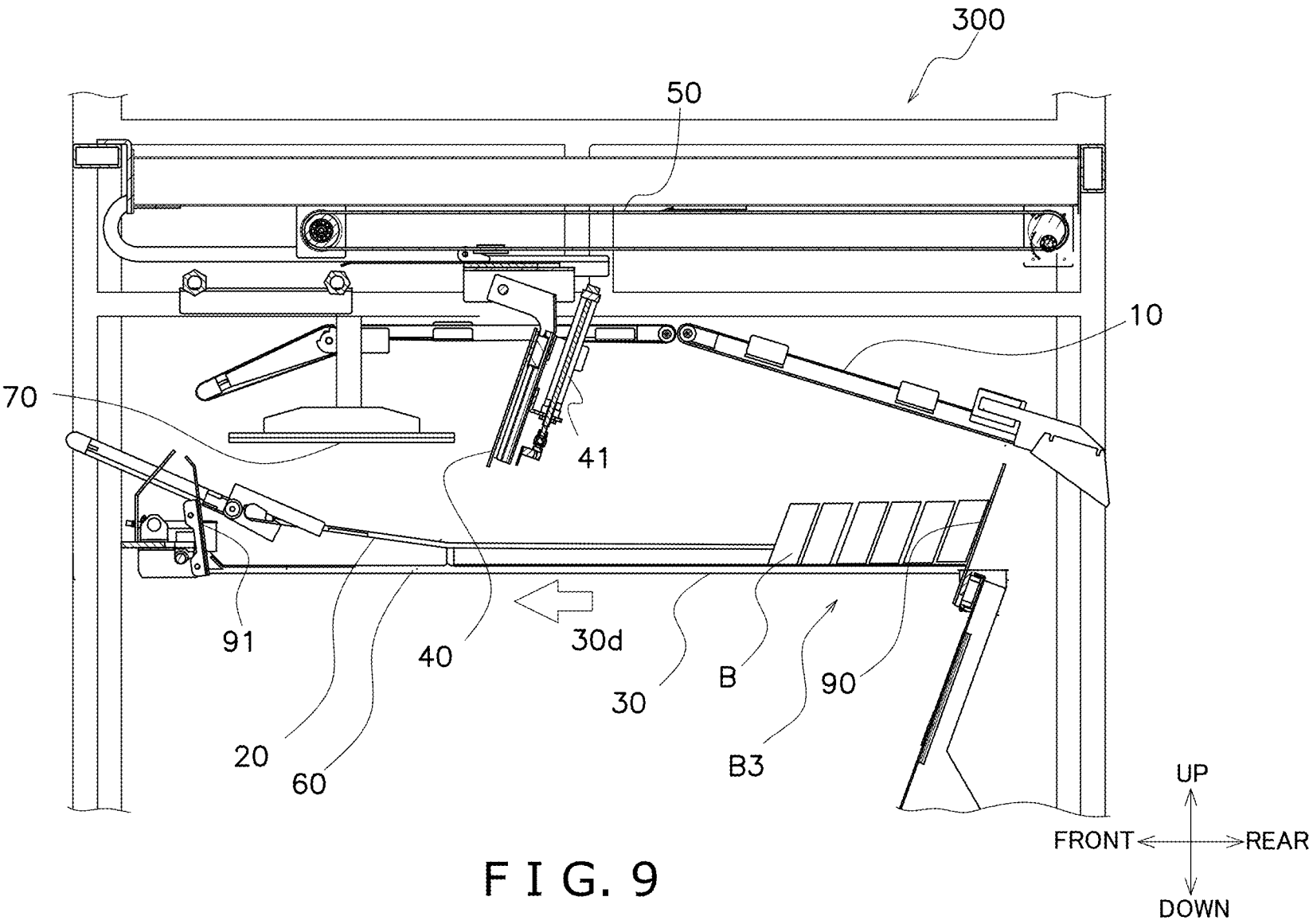
FIG. 9 is a schematic cross-sectional view of the box-packing apparatus in a left-right center state thereof.
Figure 14A:
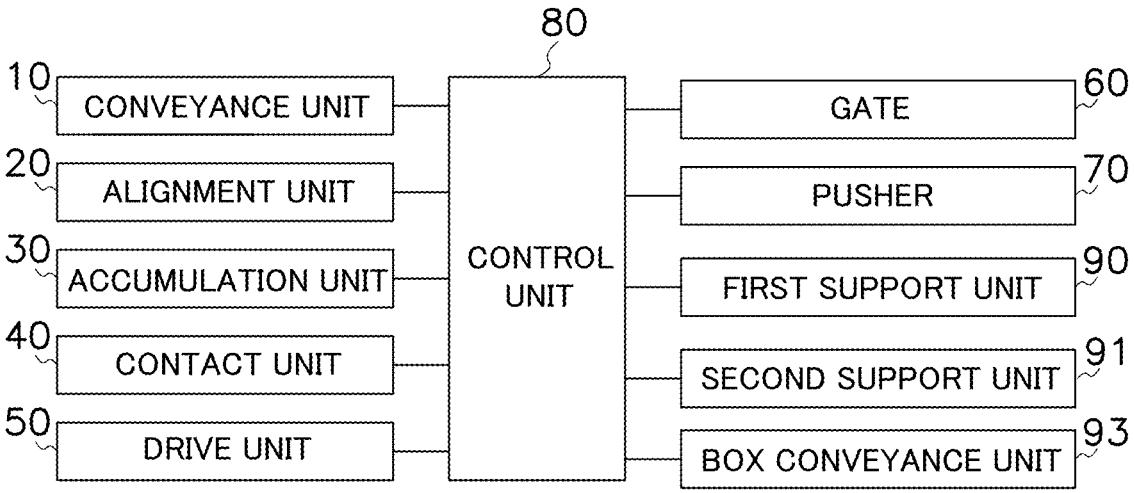
FIG. 14A is a block diagram of a control unit.

The box-packing apparatus 300 executes a box-packing operation in which it packs in a box C a predetermined accommodation number N of the bags B supplied from the inspection apparatus 200. As shown in FIG. 2, FIG. 9, and FIG. 14A, the box-packing apparatus 300 includes a conveyance unit 10, an alignment unit 20, a transfer unit 35, a contact unit 40, a drive unit 50, a gate 60, a pusher 70, a control unit 80, a first support unit 90, a second support unit 91, and a box conveyance unit 93.

(2) Detailed Configuration (2-1) Conveyance Unit

As shown in FIG. 2, the conveyance unit 10 may be a belt conveyor disposed such that a first conveyance direction 10*d* thereof is along the front and rear direction.

The conveyance unit 10 configures a first conveyance route R1. The rear side of the conveyance unit 10 is upstream on the first conveyance route R1, and the front side of the conveyance unit 10 is downstream on the first conveyance route R1.

There may be multiple conveyance units 10, e.g., two as per the exemplary embodiment. The two conveyance units 10 are disposed such that first conveyance directions 10*d* thereof are parallel. The two conveyance units 10 are disposed so as to be bilaterally symmetrical to each other across the accumulation unit 30 and the gate 60 as viewed in a plan view. The two conveyance units 10 have the same structures except that they are bilaterally symmetrical.

The conveyance unit 10 is controlled by the control unit 80.

The conveyance unit 10 has an upper surface on which the bags B are placed and conveyed along the first conveyance direction 10*d*. On the upper surface of the conveyance unit 10, a plurality of the bags B are conveyed spaced apart from each other. The direction of the bags B is not particularly limited. For example, the bags B may be conveyed such that the lengthwise direction of the bags B is along the first conveyance direction 10*d*.

The conveyance unit 10 transfers the bags B to the alignment unit 20 at a predetermined timing. Specifically, the conveyance unit 10 transfers to the alignment unit 20 disposed under the conveyance unit 10 the bags B that have been conveyed to the vicinity of the first conveyance route R1 downstream end portion of the conveyance unit 10. The bags B are conveyed such that the up and down directions or the left and right directions of the plural bags B in the series all face the first conveyance direction 10*d*.

The conveyance unit 10 may include multiple belt conveyors. In the present embodiment, the conveyance unit 10 includes an infeed belt conveyor 11, a conveyance belt conveyor 12, and a discharge belt conveyor 13. The infeed belt conveyor 11 is inclined relative to the horizontal direction. The infeed belt conveyor 11 feeds to the box-packing apparatus 300 the bags B supplied from the inspection apparatus 200. The conveyance belt conveyor 12 forms a horizontal plane. The conveyance belt conveyor 12 receives the bags B from the infeed belt conveyor 11 and conveys them to the discharge belt conveyor 13. The discharge belt conveyor 13 is inclined relative to a horizontal plane. The discharge belt conveyor 13 moves the bags B to the alignment unit 20.

(2-2) Alignment Unit

Figure 3:
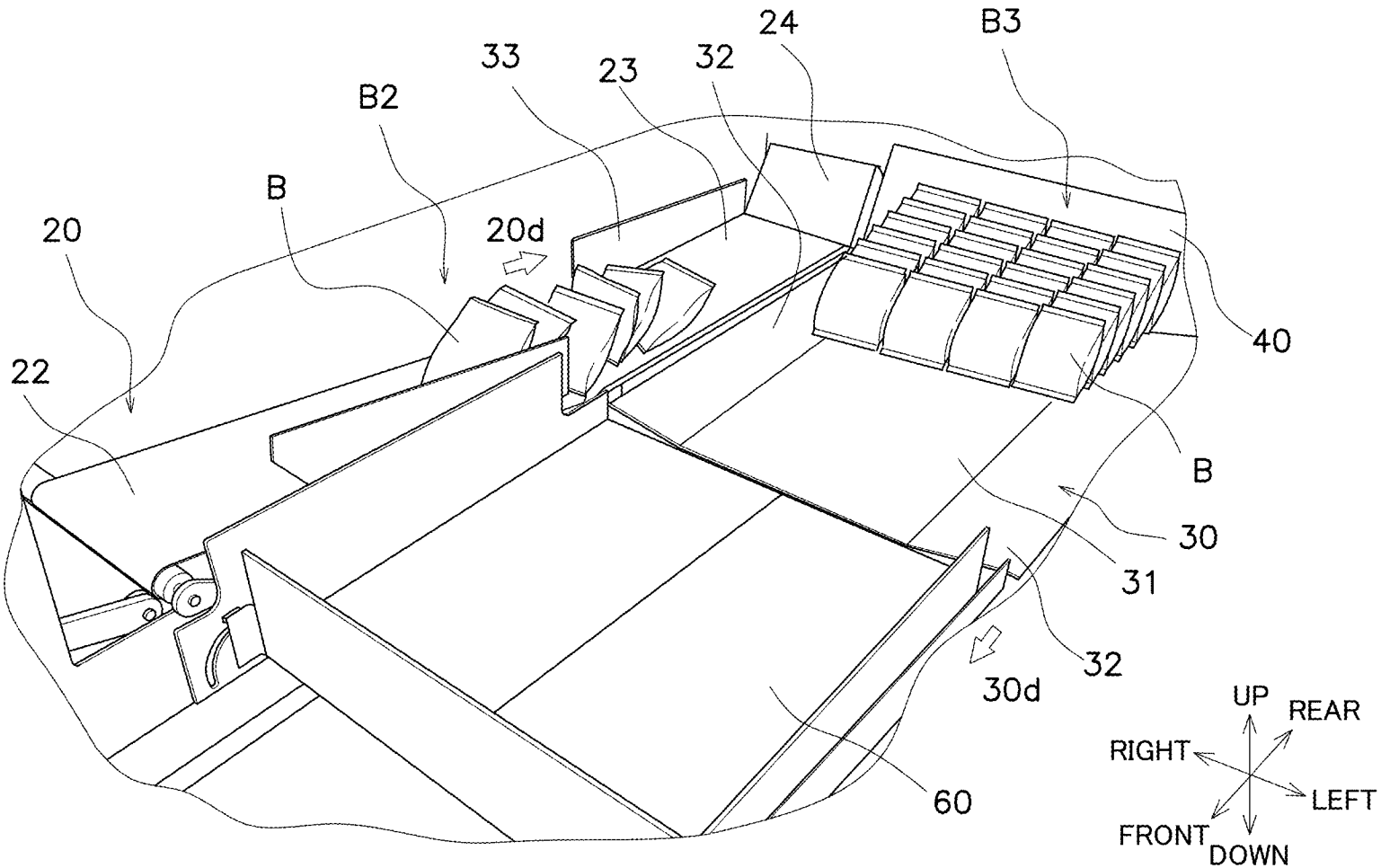
FIG. 3 is an enlarged perspective view of a portion of the box-packing apparatus illustrated in FIGS. 1 and 2.

As shown in FIG. 2 and FIG. 3, the alignment unit 20 in the disclosed embodiment is a belt conveyor disposed such that a second conveyance direction 20*d* thereof is along the front and rear direction. The second conveyance direction 20*d* faces the opposite direction of the first conveyance direction 10*d*. The alignment unit 20 configures a second conveyance route R2. The front side of the alignment unit 20 is upstream on the second conveyance route R2, and the rear side of the alignment unit 20 is downstream on the second conveyance route R2.

The alignment unit 20 is disposed under the conveyance unit 10. There may be multiple alignment units 20, e.g., two alignment units 20 as per the present exemplary embodiment. In the present embodiment, two alignment units 20 are disposed. The two alignment units 20 are disposed such that second conveyance directions 20*d* thereof are parallel. The two alignment units 20 are disposed so as to be bilaterally symmetrical to each other across the accumulation unit 30 and the gate 60 as viewed in a plan view. The two alignment units 20 have the same structures except that they are bilaterally symmetrical.

As shown in FIG. 3, the alignment unit 20 aligns the conveyed bags B in an overlapping formation so that the bags B that are mutually adjacent partially overlap to thereby form an article group B2, in so-called in Sashimi style. Specifically, at the first conveyance route R1 downstream end portion of the conveyance unit 10, a first bag B is moved to the alignment unit 20. The moving method is not particularly limited. For example, the bag B may be conveyed by the belt conveyors of the conveyance unit 10 and naturally drop from the first conveyance route R1 downstream end portion of the conveyance unit 10 to the alignment unit 20 positioned under the conveyance unit 10. The up and down direction or the left and right direction of the bag B relative to the first conveyance direction 10*d* does not change before or after the bag B naturally drops. In the present embodiment, the lengthwise direction of the bag B is along the second conveyance direction 20*d*. The first bag B that has been transferred to the alignment unit 20 is conveyed by the belt conveyor of the alignment unit 20 on the second conveyance route R2 in the second conveyance direction 20*d*.

A next bag B is moved from the conveyance unit 10 to the alignment unit 20 so that it partially overlaps the first bag B that was conveyed. By repeating this series of movements, an article group B2, in which the bags B are aligned such that the bags B that are mutually adjacent partially overlap, is formed. In the article group B2, the plural bags B are inclined in the same direction.

The alignment unit 20 is controlled by the control unit 80 to control conveyance such that a predetermined number of the bags B are aligned. In the present embodiment, the article group B2 includes six bags B.

Figure 4:
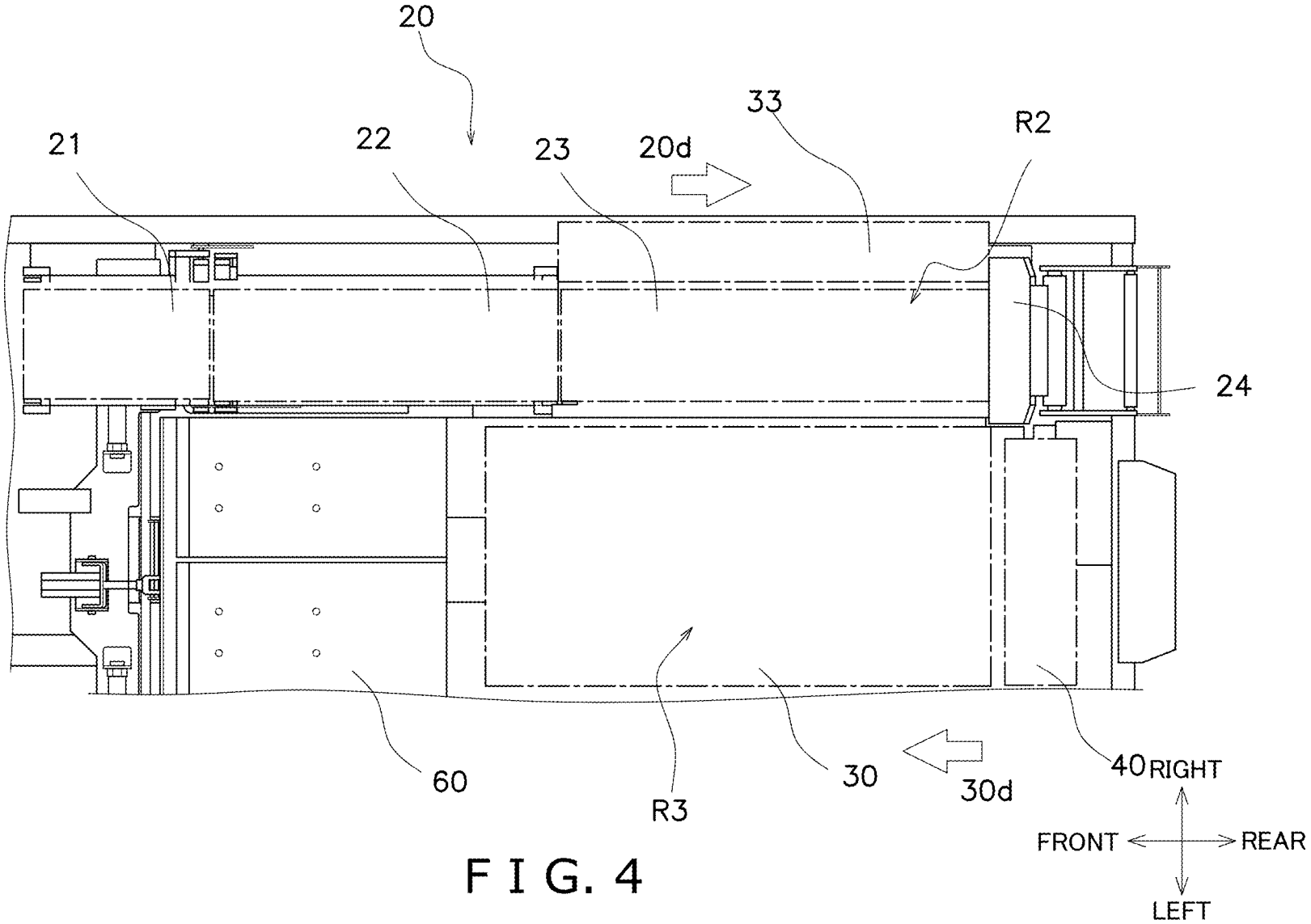
FIG. 4 is a plan view of the box-packing apparatus.

As shown in FIG. 4, the alignment unit 20 has a first alignment area 21, a second alignment area 22, a third alignment area 23, and an attitude-changing member 24.

The first alignment area 21, the second alignment area 22, and the third alignment area 23 are belt conveyors. The first alignment area 21 is inclined relative to a horizontal plane. The first alignment area 21 receives the bags B that have been moved from the conveyance unit 10. Until it receives the predetermined number of the bags B, the first alignment area 21 is stopped or operates at a low speed. Because of this, the first alignment area 21 aligns the conveyed bags B so that the bags B that are mutually adjacent partially overlap to thereby form the article group B2. The second alignment area 22 is inclined more gently than the first alignment area 21. The second alignment area 22 is disposed on the terminal end side of the first alignment area 21. The second alignment area 22 receives the article group B2 conveyed from the first alignment area 21. The second alignment area 22 operates in unison with the operation of the first alignment area 21. The third alignment area 23 is disposed on the terminal end side of the second alignment area 22. The third alignment area 23 forms a horizontal plane. The third alignment area 23 receives the article group B2 conveyed from the second alignment area 22.

The alignment unit 20 can change the compression ratio of the article group B2 when it conveys the article group B2 to the third alignment area 23. The compression ratio is the ratio of the arrangement direction length, as viewed in a plan view, of the article group B2 in the aligned state to the shortest arrangement direction length, as viewed in a plan view, of the article group B2 aligned so that the bags B that are adjacent do not overlap. The higher the compression ratio is, the shorter the arrangement direction length, as viewed in a plan view, of the aligned article group B2 becomes. In other words, in the article group B2 the bags B that are adjacent are more compactly aligned. The lower the compression ratio is, the longer the arrangement direction length, as viewed in a plan view, of the aligned article group B2 becomes. In other words, in the article group B2 the bags B that are adjacent are more spaciously aligned. The method by which the alignment unit 20 changes the compression ratio of the article group B2 is not particularly limited. For example, the alignment unit 20 may lower the compression ratio of the article group B2 by lengthening the operating time of the first alignment area 21.

Figure 5:
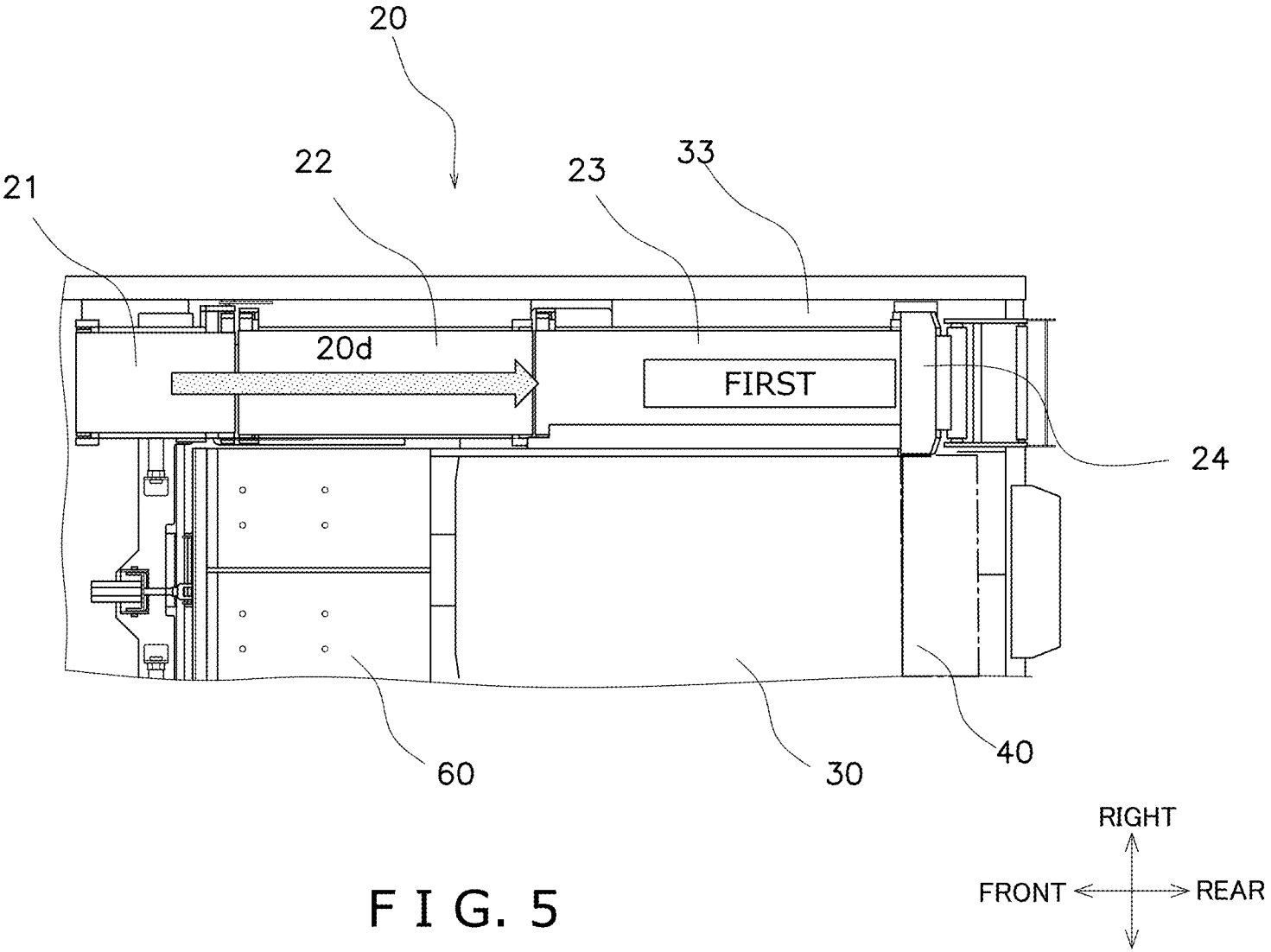
FIGS. 5 and 6 are schematic plan views which illustrate compression ratios in an alignment unit.
Figure 6:
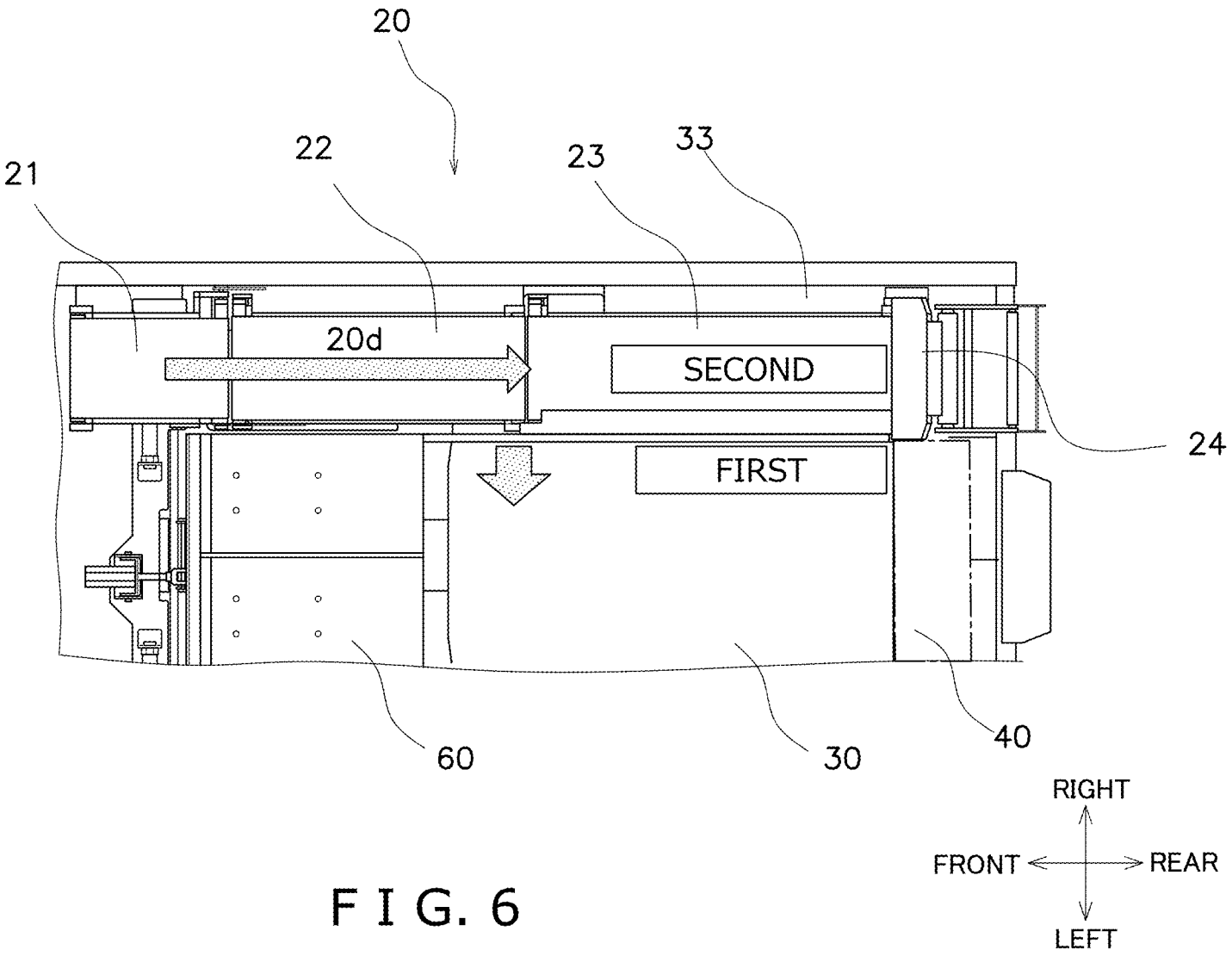

Specifically, as shown in FIG. 5, when the alignment unit 20 conveys a first article group B2 to the third alignment area 23, it makes the compression ratio of that article group B2 higher than that of the trailing article group B2. Because of this, the first article group B2 is formed shorter in the front and rear direction than the trailing article group B2. As shown in FIG. 6, when the alignment unit 20 conveys a second article group B2 to the third alignment area 23, it makes the compression ratio of that article group B2 lower than that of the first article group B2. Because of this, the second article group B2 is formed longer in the front and rear direction than the first article group B2. As a result, when the article groups B2 are moved by a side pusher 33 in a next process, the first article group B2 can be prevented from spreading in the shape of a fan.

As shown in FIG. 3, the attitude-changing member 24 is disposed on the second conveyance direction 20*d* downstream end portion of the alignment unit 20. The attitude-changing member 24 is a tabular member extending in the width direction of the alignment unit 20.

The angle of the attitude-changing member 24 relative to a horizontal plane can be changed. When the article group B2 is conveyed downstream in the second conveyance direction 20*d*, the attitude-changing member 24 contacts the bag B that is most downstream in the second conveyance direction 20*d* in the article group B2. The angle of the contact surface of the attitude-changing member 24 relative to a horizontal plane is increased to thereby raise the article group B2 so that the angle of the article group B2 relative to a horizontal plane becomes the same as or greater than the angle of the contact unit 40 relative to a horizontal plane. It will be noted that since the plural bags B are aligned in the article group B2, the angle of the article group B2 relative to a horizontal plane is the same as the angle of each bag B relative to a horizontal plane.

(2-3) Transfer Unit

As shown in FIG. 2, the transfer unit 35 transfers the aligned article group B2 to a box-packing conveyance route (hereinafter called a third conveyance route R3). The transfer unit 35 has an accumulation unit 30.

The accumulation unit 30 is disposed between the two alignment units 20. The accumulation unit 30 is disposed such that left and right end portions of the accumulation unit 30 are at the same height as the third alignment areas 23 of the alignment units 20.

The accumulation unit 30 transfers the aligned article group B2 and accumulates a plurality of the article groups B2 such that they are parallel to each other on the third conveyance route R3. The third conveyance route R3 includes the accumulation unit 30 and the gate 60. The rear side of the accumulation unit 30 is upstream on the third conveyance route R3, and the front side of the gate 60 is downstream on the third conveyance route R3.

Figure 7:
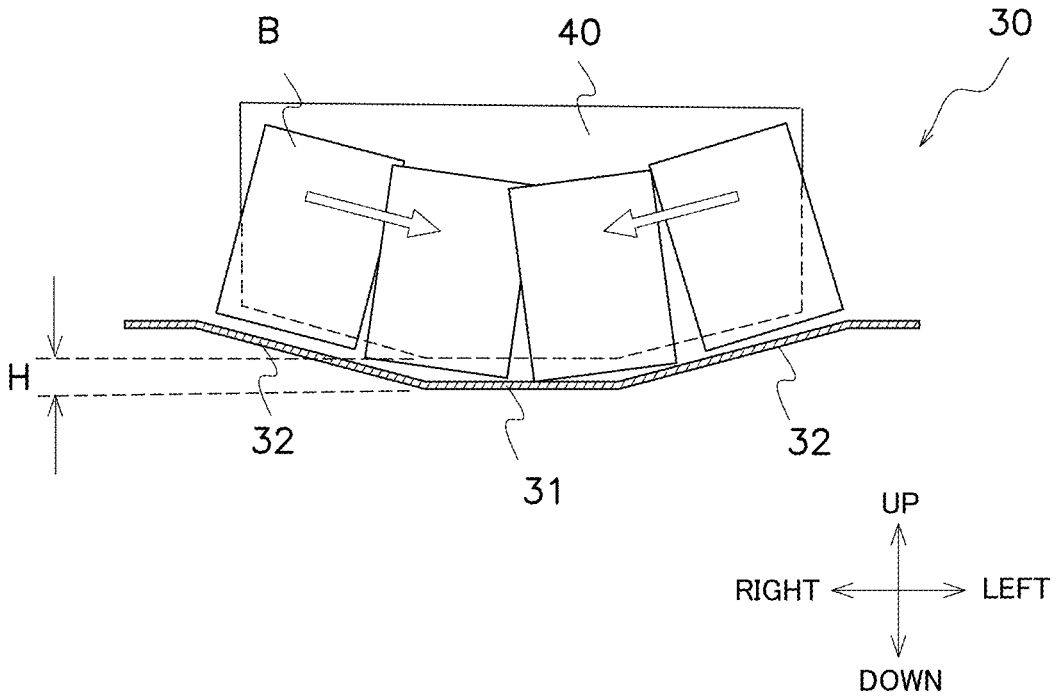
FIG. 7 is a schematic cross-sectional view of an accumulation unit as viewed from the front.

As shown in FIG. 3 and FIG. 7, the accumulation unit 30 has a bottom portion 31, two inclined surfaces 32, and a side pusher 33.

The inclined surfaces 32 are disposed on both sides of the bottom portion 31, in other words on the left and right sides of the bottom portion 31, as viewed from the front. The inclined surfaces 32 rise upward from the bottom portion 31 while inclining away from each other in directions away from the bottom portion 31. In other words, the accumulation unit 30 is valley shaped.

The angle of the inclined surfaces 32 relative to a horizontal plane is not particularly limited and may, for example, be 5 to 10 degrees. When the angle of the inclined surfaces 32 relative to a horizontal plane is 5 to 10 degrees, the article groups B2 can be prevented from going out of alignment when the article groups B2 are accumulated.

The side pusher 33 is disposed one each on the outer sides of both the left and right edges of the third alignment areas 23 of the alignment units 20. Each side pusher 33 is a tabular member that extends parallel to the second conveyance direction 20*d* and is disposed perpendicular to a horizontal plane. The front and rear direction length of the side pusher 33 is the same as or shorter than the front and rear direction length of the third alignment area 23 of the alignment unit 20. The side pusher 33 can move the article group B2 in a direction perpendicular to the box-packing conveyance direction (hereinafter called a third conveyance direction 30*d*). It will be noted that the third conveyance direction 30*d* faces the same direction as the first conveyance direction 10*d*. The third conveyance direction 30*d* faces the opposite direction of the second conveyance direction 20*d*.

The side pushers 33 move the article groups B2 laterally in directions perpendicular to the third conveyance direction 30*d* while maintaining the aligned state of the article groups B2. Specifically, the side pushers 33 move the aligned article groups B2 from left and right toward the center portion of the accumulation unit 30 while staying parallel to the alignment unit 20. The side pushers 33 are controlled by the control unit 80.

After the side pushers 33 move the first article groups B2 laterally, they return to their original positions, in other words the outer sides of both the left and right edges of the third alignment areas 23 of the alignment units 20. When the side pushers 33 return to their original positions, the next article groups B2 are delivered to the third alignment areas 23. The side pushers 33 similarly move the next article groups B2 toward the center portion of the accumulation unit 30. By repeating this series of movements multiple times, the accumulation unit 30 accumulates a plurality of the article groups B2 such that they are parallel to each other on the third conveyance route. The multiple article groups B2 that have been accumulated by the accumulation unit 30 will hereinafter be called an accumulated article group B3. Just after being moved laterally by the side pushers 33, the accumulated article group B3 is accumulated in a state in which it is inclined 70 degrees relative to a horizontal plane.

In the present embodiment, each side pusher 33 repeats this lateral movement of an article group B2 twice. Because of this, four article groups B2 become lined up parallel to each other on the accumulation unit 30 to form the accumulated article group B3.

(2-4) Contact Unit

As shown in FIG. 3, the contact unit 40 is disposed on the third conveyance direction 30*d* upstream end portion of the accumulation unit 30. The contact unit 40 is a tabular member extending in the left and right direction of the accumulation unit 30. The length of the accumulation unit 30 in its width direction (the left and right direction) is longer than the length of the contact unit 40 in its width direction (the left and right direction).

As shown in FIG. 7, the length of the accumulation unit 30 in its width direction (the left and right direction) is longer than the length of the contact unit 40 in its width direction (the left and right direction). Although it is not particularly limited, as viewed from the front the shape of the lower end of the contact unit 40 conforms to the shape of the upper surface of the accumulation unit 30. Specifically, as viewed from the front the lower end of the contact unit 40 is mountain shaped along the bottom portion 31 and the inclined surfaces 32 of the accumulation unit 30.

Figure 15:
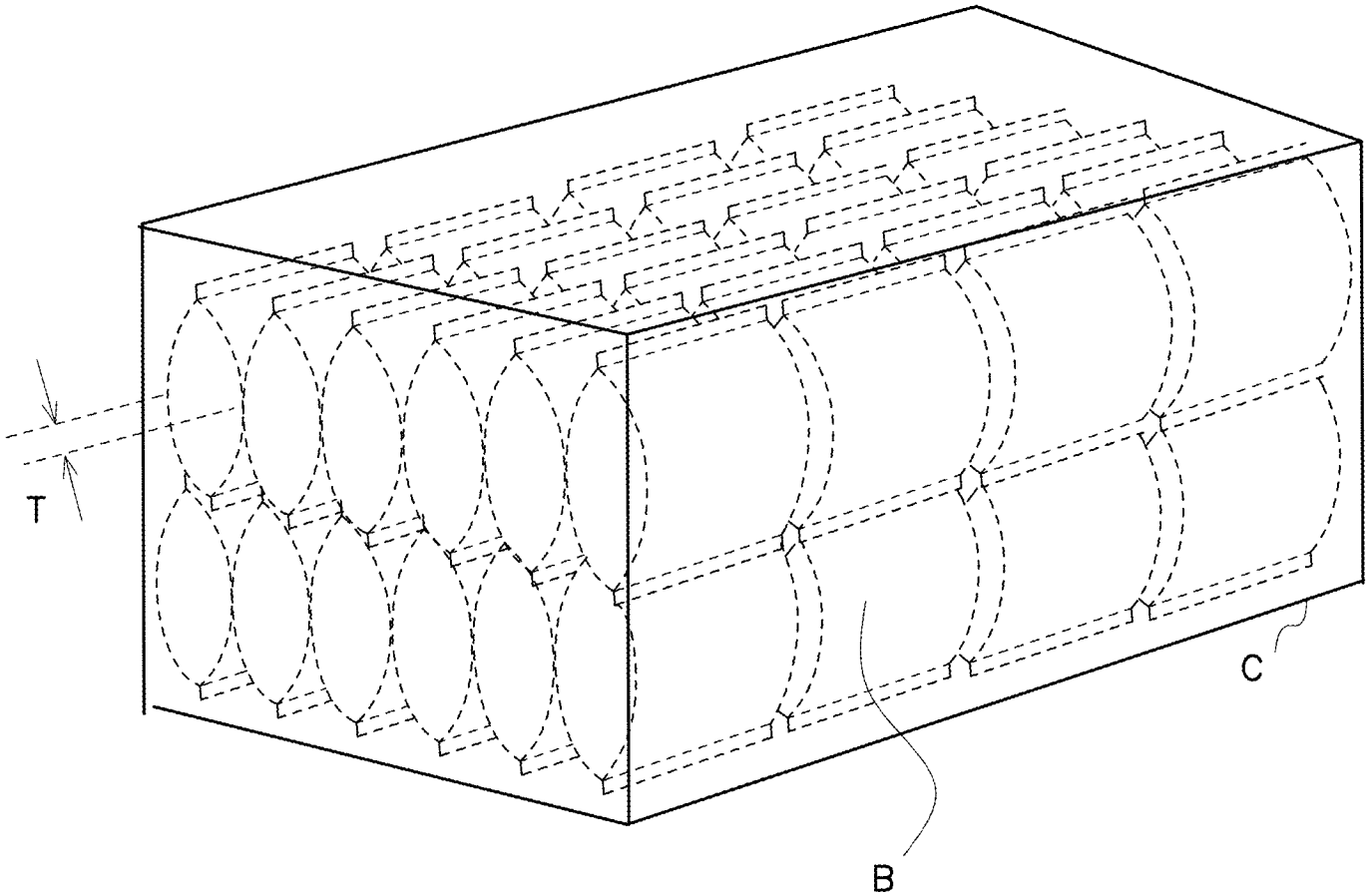
FIG. 15 is a schematic diagram of a box C and bags B packed by the box-packing apparatus shown in FIGS. 1 and 2.

As shown in FIG. 7 and FIG. 15, a distance H between the accumulation unit 30 and the contact unit 40 is shorter than a thickness T of the bags B. Specifically, the distance H between the bottom portion 31 of the accumulation unit 30 and the contact unit 40 is shorter than the thickness T of the bags B.

Figure 8:
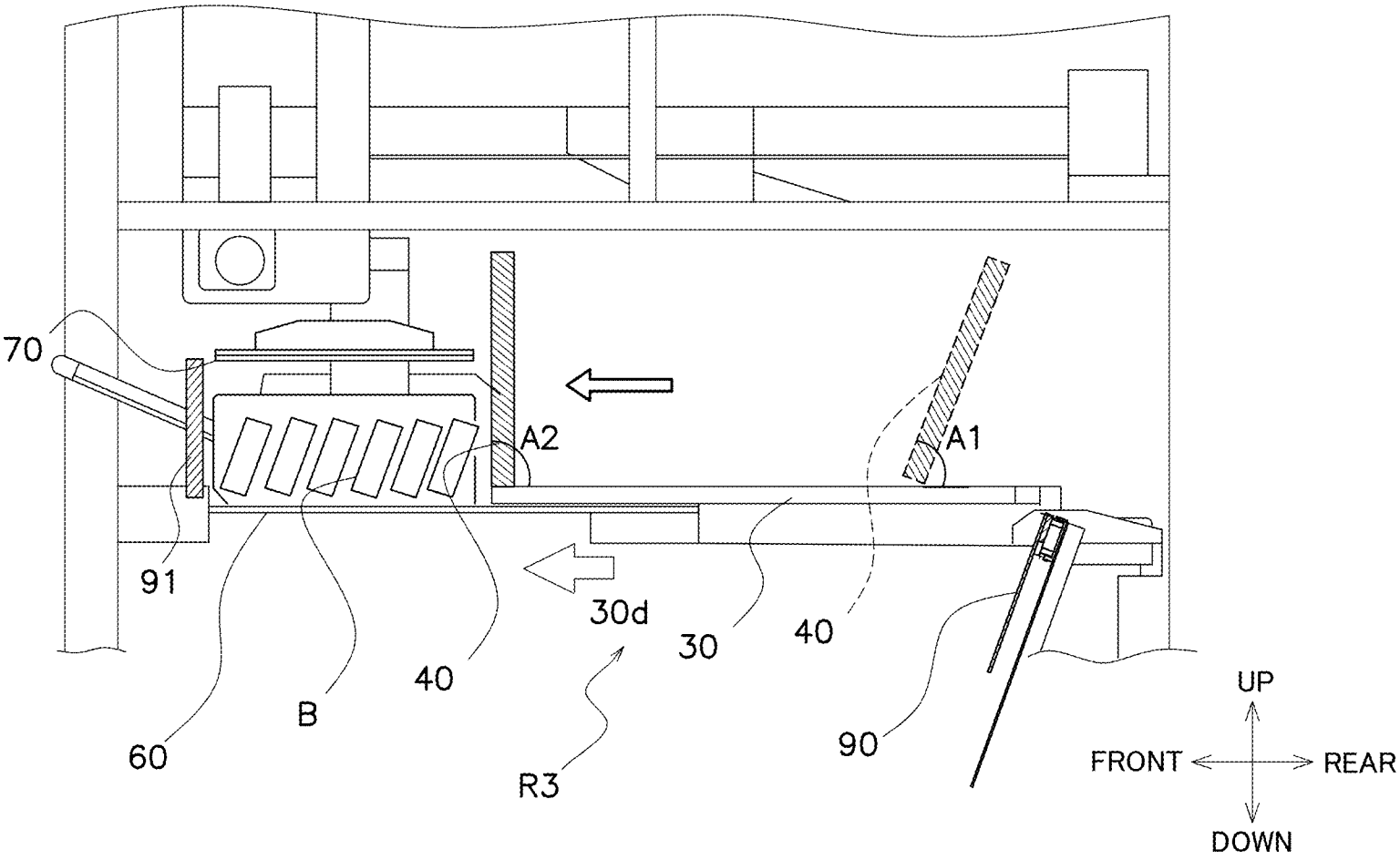
FIG. 8 is a schematic cross-sectional view of the box-packing apparatus illustrating operation of a contact unit.

As shown in FIG. 8, the contact unit 40 is inclined at a predetermined angle relative to a horizontal plane. Although it is not particularly limited, the contact unit 40 may, for example, be inclined 60 to 70 degrees relative to a horizontal plane. The angle formed by a contact surface of the contact unit 40 and a horizontal plane can be changed from a first angle A1 to a second angle A2. The second angle A2 is larger than the first angle A1. The angle formed by the contact surface of the contact unit 40 and a horizontal plane may be changed over multiple stages.

The contact unit 40 is controlled by the control unit 80.

FIG. 9 is a schematical cross-sectional view of the box-packing apparatus 300 when the contact unit 40 has moved to the terminal end side of the accumulation unit 30. As shown in FIG. 9, the contact unit 40 is movable along the third conveyance direction 30*d*. The contact unit 40 is driven by the drive unit 50 to move along the third conveyance direction 30*d*. The angle formed by the contact surface of the contact member 40 and a horizontal plane can be changed from the first angle A1 to the second angle A2 after the contact unit 40 starts moving along the third conveyance direction 30*d*. The moving speed of the contact unit 40 can be changed while the contact unit 40 is moving along the third conveyance direction 30*d*.

The contact unit 40 is movable in the up and down direction. The contact unit 40 is driven by a cylinder 41 to move up and down. The method by which the contact unit 40 is moved in the up and down direction is not particularly limited and may, for example, use a cylinder.

The contact unit 40 is movable in the shape of a box. That is, the contact unit 40 starts from the third conveyance direction 30*d* upstream end portion of the accumulation unit 30 and is driven by the drive unit 50 to move to the third conveyance direction 30*d* downstream end portion of the accumulation unit 30. Because of this, the accumulated article group B3 is conveyed to the gate 60. When it finishes this conveyance, the contact unit 40 is driven by the cylinder 41 to ascend. The height to which the contact unit 40 ascends is higher than the height of the bags B. In the ascended state, the contact unit 40 is driven by the drive unit 50 to move to the third conveyance direction 30*d* upstream side of the accumulation unit 30. The contact unit 40 is driven by the cylinder 41 to descend and returns to the start position.

The contact unit 40 contacts the bags B that are on the third conveyance route most upstream side (the third conveyance route starting end side) in the accumulated article group B3. In other words, the contact unit 40 supports the bags B that were conveyed first by the alignment unit 20 out of each of the article groups B2. When a plurality of the article groups B2 are accumulated, the contact unit 40 collectively conveys the accumulated article group B3 in the third conveyance direction 30*d* to move it to the gate 60.

(2-5) First Support Unit

The first support unit 90 is disposed on the third conveyance route upstream side of the accumulation unit 30. The first support unit 90 extends in the left and right direction of the accumulation unit 30.

The first support unit 90 is movable in the up and down direction. The method by which the first support unit 90 is moved in the up and down direction is not particularly limited and may, for example, use a cylinder. The first support unit 90 does not move along the third conveyance direction 30*d*.

The first support unit 90 is inclined at the same angle as the angle at which the contact unit 40 is inclined relative to a horizontal plane on the third conveyance direction 30*d* upstream side. Although it is not particularly limited, the first support unit 90 may, for example, be inclined 60 to 70 degrees relative to a horizontal plane.

The first support unit 90 is controlled by the control unit 80.

While the contact unit 40 is moving the first accumulated article group B3, the first support unit 90 supports the bags B that are on the third conveyance route most upstream side in the article group B3 that has been accumulated next. When the contact unit 40 returns to the third conveyance route most upstream side, the first support unit 90 descends so that the upper end of the first support unit 90 is positioned lower than the upper surface of the accumulation unit 30 to ensure that it does not hinder the movement of the contact unit 40 in the third conveyance direction 30*d*.

(2-6) Drive Unit

The drive unit 50 drives the contact unit 40. The drive unit 50 is controlled by the control unit 80.

The drive unit 50 is not particularly limited. In the present embodiment, the drive unit 50 is a belt.

During box-packing, the drive unit 50 moves the contact unit 40 from the third conveyance direction upstream side of the accumulation unit 30 to the third conveyance direction downstream side. When the accumulated article group B3 is conveyed to the gate 60, the drive unit 50 raises the contact unit 40 and moves it from the third conveyance direction downstream side of the accumulation unit 30 to the third conveyance direction upstream side. When the contact unit 40 reaches the third conveyance direction upstream end portion of the accumulation unit 30, the drive unit 50 lowers the contact unit 40 to the back side of the first support unit 90, in other words the side opposite the accumulated article group B3.

(2-7) Second Support Unit

The second support unit 91 is disposed on the third conveyance direction downstream side of the gate 60. The second support unit 91 is a tabular member extending in the left and right direction of the gate 60. The second support unit 91 is disposed at a 90-degree angle relative to a horizontal plane. The angle of the second support unit 91 relative to a horizontal plane can be changed. The second support unit 91 is controlled by the control unit 80.

The second support unit 91 contacts the bags B that are on the third conveyance route most downstream side.

Figure 10:
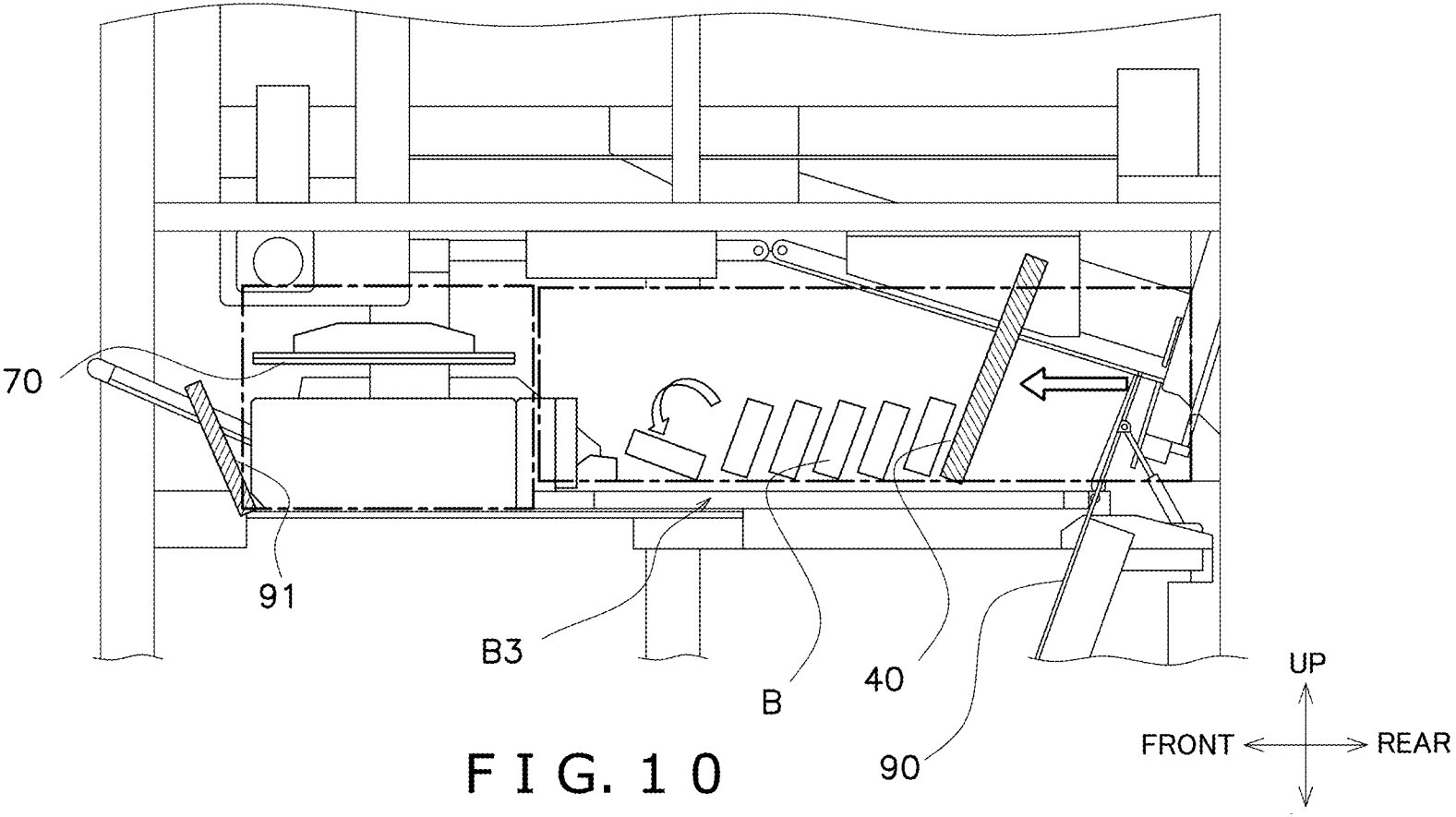
FIG. 10 is a schematic diagram illustrating the action of a second support unit.
Figure 11:
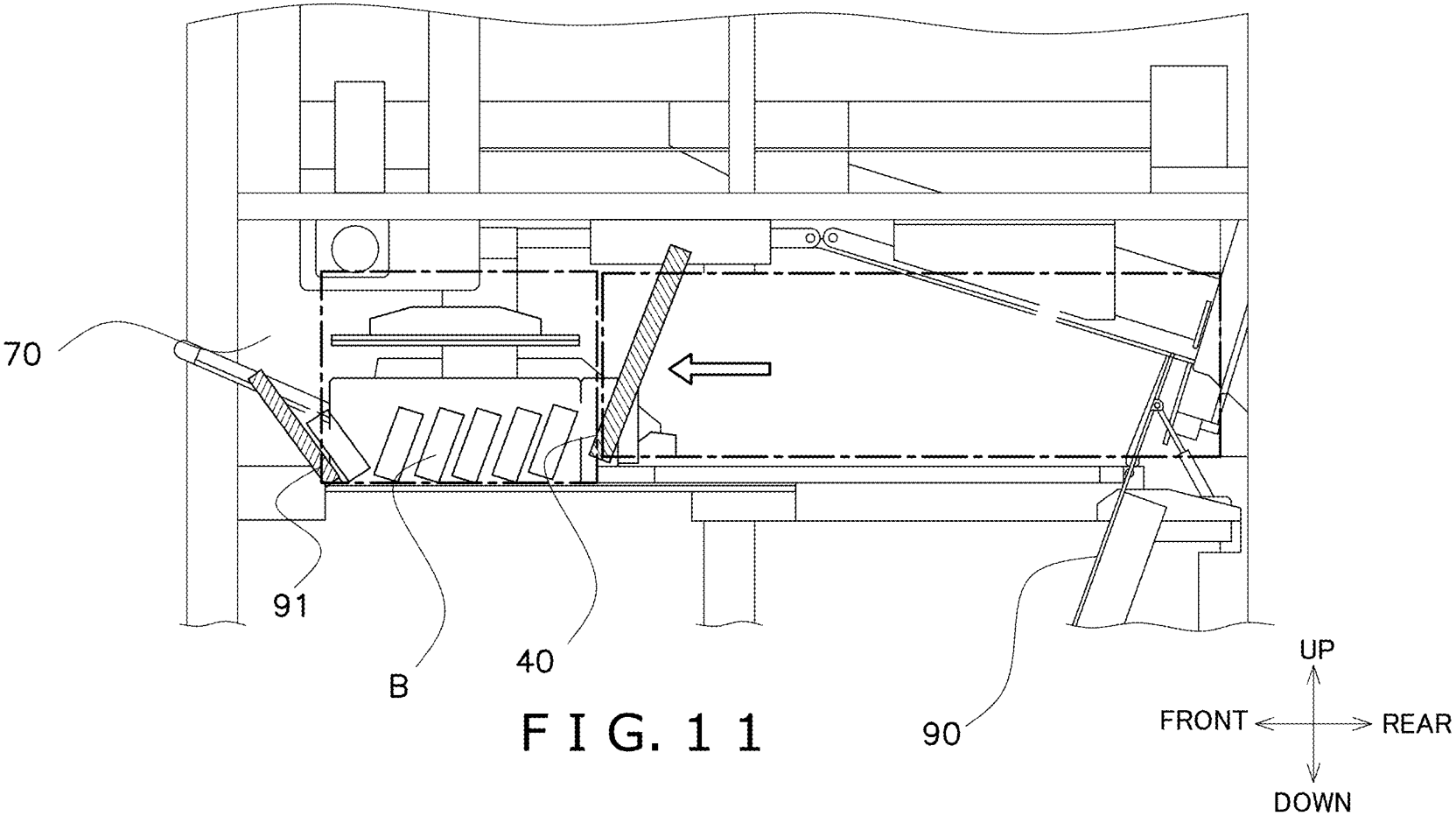
FIG. 11 is a schematic diagram illustrating the action of the second support unit.
Figure 12:
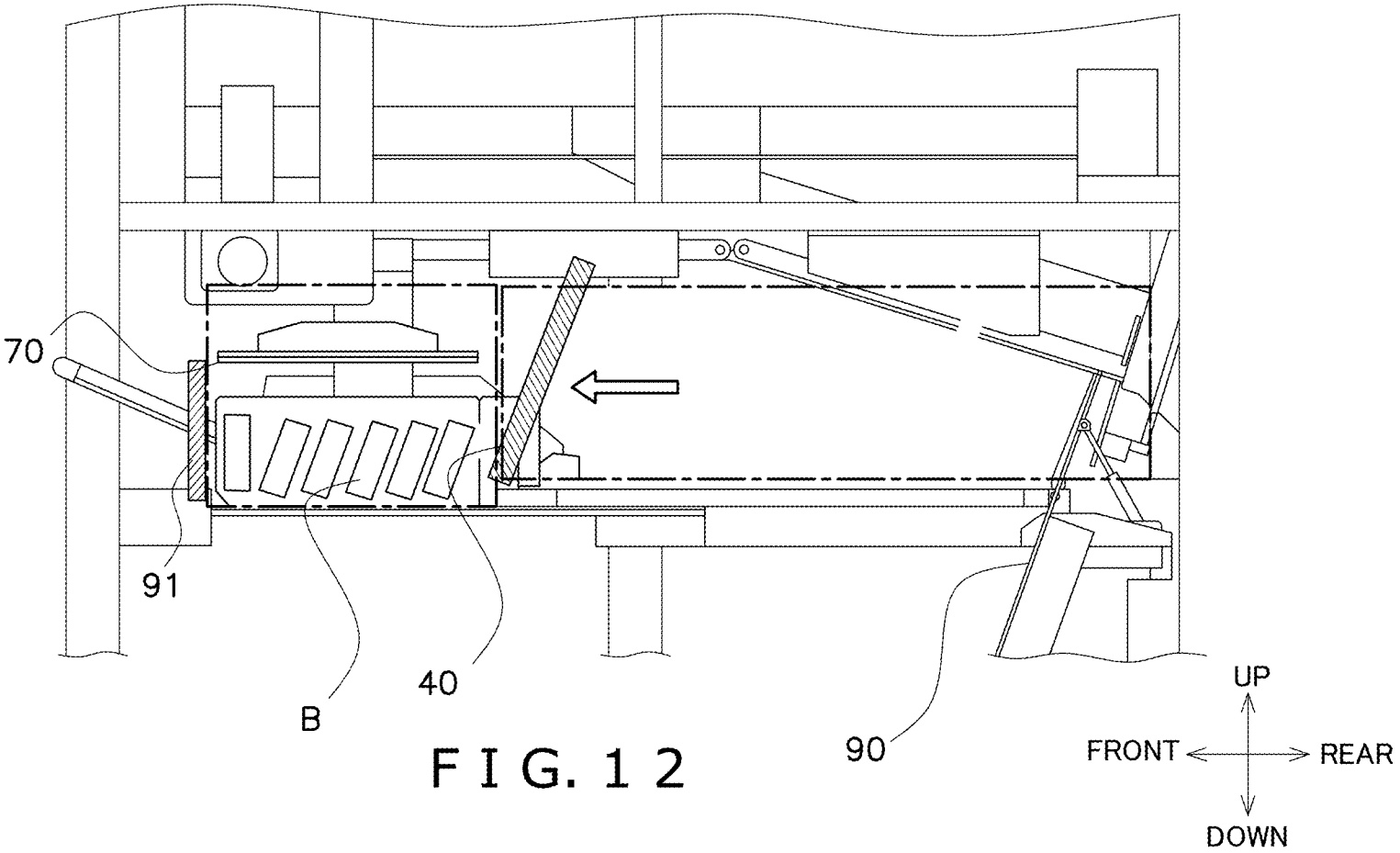
FIG. 12 is a schematic diagram illustrating the action of the second support unit.

As shown in FIG. 10, while the accumulated article group B3 is being moved by the contact unit 40 to the gate 60, the bags B that are on the third conveyance route downstream side in the accumulated article group B3 may end up falling over due to inertia if the box-packing apparatus 300 makes an emergency shutdown. In that case, the second support unit 91 inclines such that its angle relative to a horizontal plane is 45 degrees and waits for the accumulated article group B3. When, as shown in FIG. 11, the accumulated article group B3 is moved to the gate 60 and the bags B that are on the third conveyance route downstream side contact the second support unit 91, as shown in FIG. 12 the second support unit 91 rises to 90 degrees relative to a horizontal plane and supports the bags B on the third conveyance route downstream side of the gate 60. Because of this, the bags B that are on the third conveyance route downstream side and had fallen over are raised so that their angle relative to a horizontal plane becomes the same as the angle of the other bags B relative to a horizontal plane, and the accumulated article group B3 can be packed without its aligned state being disrupted.

(2-8) Gate

The gate 60 is disposed on the third conveyance route downstream side of the accumulation unit 30. The gate 60 is positioned above a box-packing position of the box conveyance unit 93.

The gate 60 is positioned on the third conveyance route terminal end and supports the article group B3.

The gate 60 is controlled by the control unit 80. The gate 60 feeds the article group B3 that has been transferred from the accumulation unit 30 into the box C. Just before being fed, the bags B of the article group B3 on the gate 60 are each standing upright perpendicular to a horizontal plane.

The gate 60 opens in one go in the left and right directions from its center portion and collectively feeds the article group B3 into the box C. The operation of feeding the article group B3 into the box C may be performed multiple times with respect to one box C.

(2-9) Pusher

Figure 13:
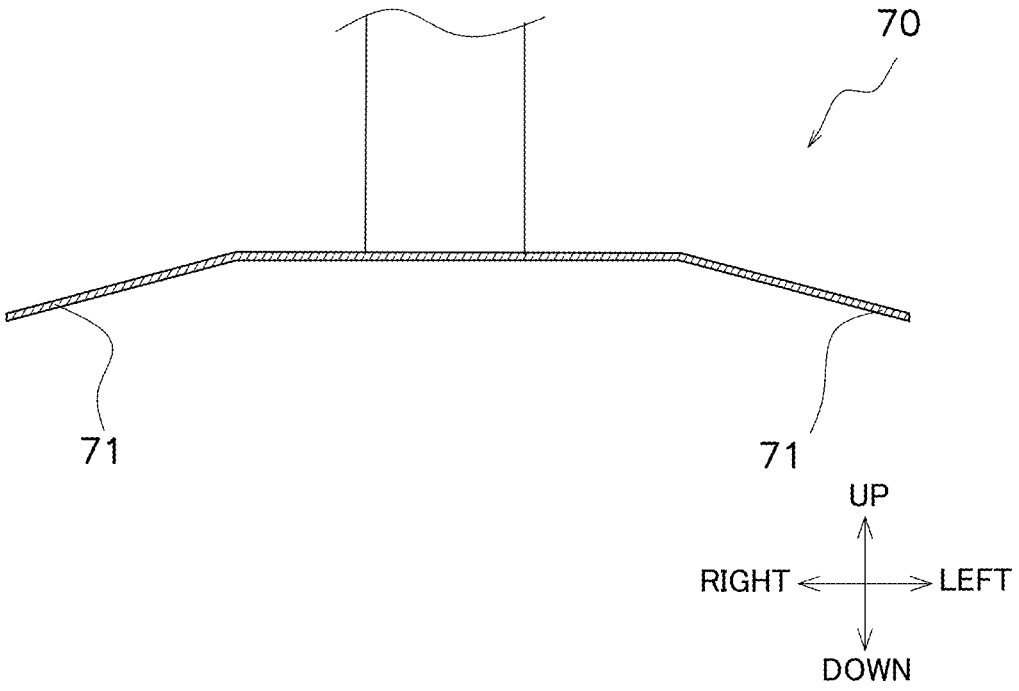
FIG. 13 is a schematic cross-sectional view of a pusher as viewed from the front.

The pusher 70 is disposed above the gate 60. The pusher 70 is movable in the up and down direction. The pusher 70 is a tabular member having a horizontal surface. The pusher 70 contacts the upper surface of the accumulated article group B3. As shown in FIG. 13, the pusher 70 has down-bent portions 71. The down-bent portions 71 are bent down toward the bags B.

The pusher 70 is controlled by the control unit 80. The pusher 70 contacts from above and pushes downward the accumulated article group B3 on the gate 60. The pusher 70 pushes downward the accumulated article group B3 at a speed faster than gravitational acceleration that acts on the accumulated article group B3. The pusher 70 collectively packs the article group B3.

(2-10) Box Conveyance Unit

The box conveyance unit 93 performs infeed conveyance of the boxes C in which the bags B are not yet packed to the box-packing position and outfeed conveyance of the boxes C in which the bags B have been packed. The box-packing position is provided under the gate 60 so that the boxes C can receive the bags B fed thereto from the gate 60. The box conveyance unit 93 is controlled by the control unit 80.

(2-11) Control Unit

The control unit 80 controls each part of the box-packing apparatus 300 to implement the box-packing operation. Details about the box-packing operation will be described later. FIG. 14A is a block diagram of the control unit 80. The control unit 80 is electrically connected to, so as to be capable of sending control signals to and receiving detection signals from, the conveyance unit 10, the alignment unit 20, the accumulation unit 30, the contact unit 40, the drive unit 50, the gate 60, the pusher 70, the first support unit 90, the second support unit 91, and the box conveyance unit 93.

The control unit 80 controls the drive unit 50 to move the contact unit 40 in the alignment direction of the accumulated article group B3 (the third conveyance direction 30*d*) in a state in which the contact unit 40 is contacting and supporting the bags B that are on the third conveyance route upstream side. As shown in FIG. 8, at the same time, the control unit 80 changes the angle formed by the contact surface of the contact unit 40 and a horizontal plane from the first angle A1 to the second angle A2 after the contact unit 40 starts moving the accumulated article group B3. The second angle is larger than the first angle. In the present embodiment, the first angle is 60 to 70 degrees. The second angle is 90 degrees. The control unit 80 may control the contact unit 40 to change over multiple stages the angle formed by the contact surface and a horizontal plane.

The control unit 80 changes the angle formed by the contact surface of the contact unit 40 and a horizontal plane from the first angle A1 to the second angle A2 from when it starts moving the contact unit 40 to until it finishes moving the contact unit 40.

The control unit 80 is implemented by a computer. The control unit 80 includes a control arithmetic unit and a storage unit. For the control arithmetic unit, a processor such as a CPU or a GPU can be used. The control arithmetic unit reads programs stored in the storage unit and performs predetermined arithmetic processing in accordance with the programs. Moreover, the control arithmetic unit can write arithmetic results to the storage unit and read information stored in the storage unit in accordance with the programs.

(3) Box-packing Operation

Figure 14B:
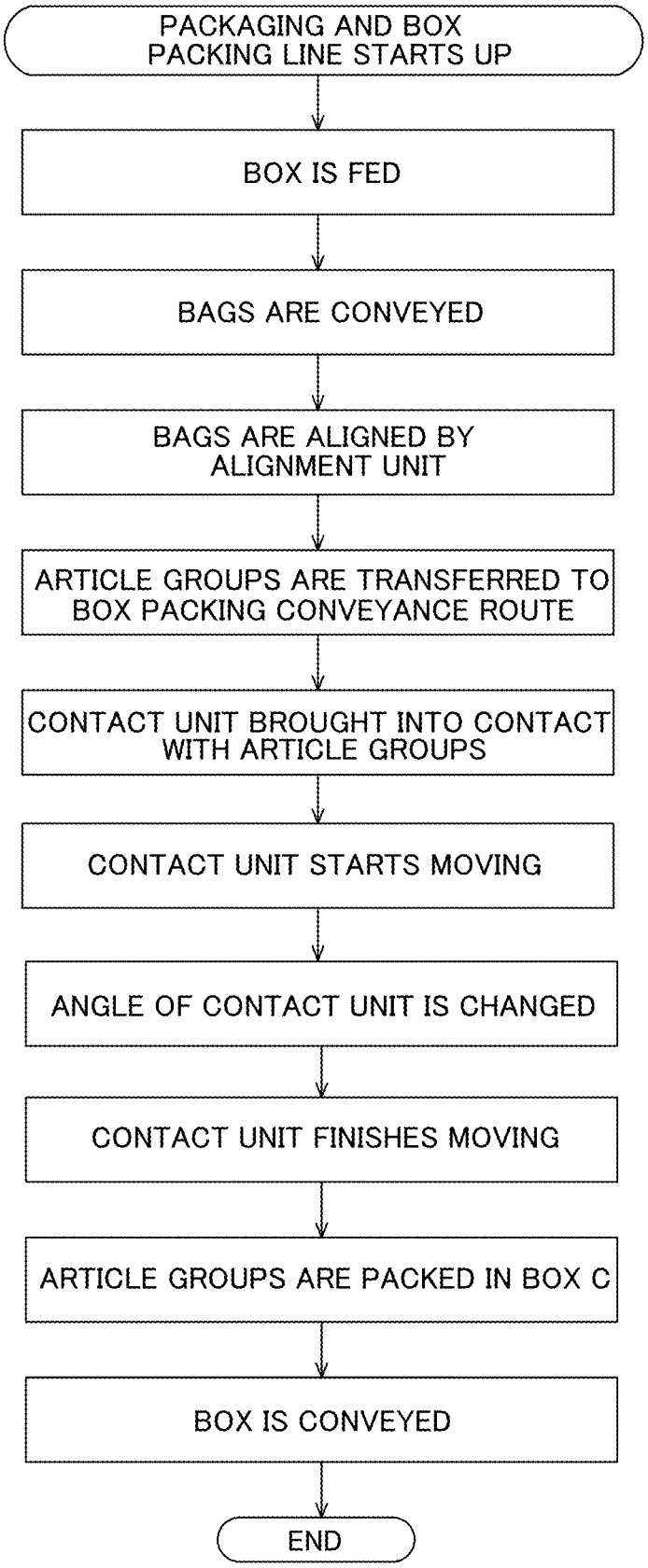
FIG. 14B is a flowchart of a box-packing operation.

The box-packing operation is an operation that repeatedly packs the predetermined accommodation number N of the bags B in the boxes C. As shown in FIG. 14B, the box-packing operation is started when, for example, the packaging and box-packing line 1 starts up.

The control unit 80 performs a box-infeed conveyance process. The box-infeed conveyance process is a process that conveys a box C to the box-packing position. The box-infeed conveyance process is a process where the box conveyance unit 93 conveys to the box-packing position a box C in which the bags B are not yet packed.

The control unit 80 causes the conveyance unit 10 to convey the bags B supplied from the inspection apparatus 200. When the bags B are conveyed to the vicinity of the downstream end portion in the first conveyance direction 10*d*, the bags B are conveyed by the belt conveyors of the conveyance unit 10 and thus naturally drop from the downstream end portion of the conveyance unit 10 to the alignment unit 20 positioned under the conveyance unit 10.

The control unit 80 causes the alignment unit 20 to align the bags B conveyed by the conveyance unit 10. Specifically, in the first alignment area 21 of the alignment unit 20, the next bag B is transferred to the alignment unit 20 such that it partially overlaps the first bag B that was conveyed. The control unit 80 controls the alignment unit 20 so that, when the alignment unit 20 conveys the first article group B2 to the third alignment area 23, it makes the compression ratio of that article group B2 higher than that of the trailing article group B2.

When the article group B2 is conveyed downstream in the second conveyance direction 20*d*, the control unit 80 controls the attitude-changing member 24 to causes the attitude-changing member 24 to contact the bag B that is most downstream in the second conveyance direction 20*d* in the article group B2. The control unit 80 controls the attitude-changing member 24 to increase the angle of the attitude-changing member 24 relative to a horizontal plane to raise the article group B2 until the angle of the article group B2 relative to a horizontal plane becomes the same as the angle of the contact unit 40 relative to a horizontal plane.

The control unit 80 causes the side pusher 33 to move the article group B2 laterally in a direction perpendicular to the box-packing conveyance direction (the third conveyance direction 30*d*) while maintaining the aligned state of the article group B2. Because of this, the article group B2 is accumulated by the accumulation unit 30.

The control unit 80 controls the drive unit 50 to move the contact unit 40 toward the third conveyance route R3 downstream side. The control unit 80 changes the angle formed by the contact surface of the contact unit 40 and a horizontal plane from the first angle A1 to the second angle A2 from when it starts moving the contact unit 40 to until it finishes moving the contact unit 40 in a state in which the contact unit 40 is contacting and supporting the bags B that are on the third conveyance route upstream side. Because of this, the contact unit 40 collectively moves onto the gate 60 the article group B3 that has been accumulated by the accumulation unit 30. When the movement of the contact unit 40 toward the third conveyance route R3 downstream side begins, the control unit 80 causes the side pusher 33 to return to its original position on the outer side of the alignment unit 20.

While the control unit 80 is causing the contact unit 40 to move the first accumulated article group B3, it controls the first support unit 90 to cause the first support unit 90 to rise and support the second article group B3.

When the contact unit 40 finishes moving the first accumulated article group B3, the control unit 80 controls the drive unit 50 to raise the contact unit 40 and move it to the third conveyance route R3 upstream side. The contact unit 40 moves over the second accumulated article group B3 to the third conveyance route R3 upstream side. The control unit 80 lowers the contact unit 40 and causes the contact unit 40 to wait on the third conveyance route R3 upstream side of the first support unit 90.

The control unit 80 lowers the first support unit 90. Because of this, the contact unit 40 supports the second accumulated article group B3.

The control unit 80 drives the gate 60 and the pusher 70 to collectively pack the accumulated article group B3 in the box C positioned under the gate 60.

The control unit 80 repeats the above series of box-packing operations and judges whether a number Nn1 of the bags B that have been fed into the box C has reached a predetermined number Nf1.

As shown in FIG. 15, in the present embodiment, an accumulated article group B3 comprising twenty-four bags B is packed twice, so a total of forty-eight bags B are packed.

The control unit 80 starts a box conveyance process. The box conveyance process is a process of conveying out the box C in which the bags B have been packed.

(4) Characteristics 4-1

The box-packing apparatus 300 of the present embodiment includes the conveyance unit 10, the alignment unit 20, the transfer unit 35, the contact unit 40, the drive unit 50, and the control unit 80. The conveyance unit 10 conveys plural bags B from outside. The alignment unit 20 aligns the conveyed articles so that the articles that are mutually adjacent partially overlap to thereby form the article group B2. The transfer unit 35 transfers the aligned article group B2 to the third conveyance route R3. The contact unit 40 contacts the bags B that are on the box-packing conveyance route upstream side in the transferred article group B2. The drive unit 50 drives the contact unit 40. The control unit 80 controls the drive unit 50 to move the contact unit 40 in the alignment direction of the article group B2 in a state in which the contact unit 40 is contacting and supporting the bags B that are on the third conveyance route R3 upstream side and changes the angle formed by the contact surface of the contact unit 40 and a horizontal plane from the first angle A1 to the second angle A2 larger than the first angle A1 after the contact unit 40 starts moving.

In this box-packing apparatus, while the aligned article group B2 is being collectively moved on the third conveyance route R3, the angle of the bags B relative to a horizontal plane can be collectively changed to an angle at which it is easy to pack the bags B. As a result, a large quantity of articles can be packed in a short period of time and in an ordered state.

4-2

In the box-packing apparatus 300 of the present embodiment, the control unit 80 changes the angle formed by the contact surface of the contact unit 40 and a horizontal plane from the first angle A1 to the second angle A2 from when it starts moving the contact unit 40 to until it finishes moving the contact unit 40.

In this box-packing apparatus 300, while the aligned article group B2 is being moved on the third conveyance route R3, the angle of the bags B relative to a horizontal plane can be collectively changed. For that reason, the amount of time it takes for the box-packing work can be shortened.

4-3

In the box-packing apparatus 300 of the present embodiment, the transfer unit 35 moves the article group B2 laterally in a direction perpendicular to the conveyance direction while maintaining its aligned state.

In this box-packing apparatus 300, the aligned article group B2 can be collectively moved to the third conveyance route R3. For that reason, the amount of time it takes for the box-packing work can be shortened.

4-4

In the box-packing apparatus 300 of the present embodiment, there are multiple alignment units 20 and conveyance units 10.

In this box-packing apparatus 300, the bags B can be conveyed and packed from the multiple alignment units 20 and conveyance units 10, so the amount of time it takes for the box-packing work can be shortened.

4-5

The box-packing apparatus 300 further includes the accumulation unit 30. The accumulation unit 30 accumulates multiple article groups B2 such that they are parallel to each other on the third conveyance route R3. The accumulation unit 30 has the bottom portion 31 and the two inclined surfaces 32. The two inclined surfaces 32 are disposed on both sides of the bottom portion 31 as viewed from the front and rise upward from the bottom portion 31 while inclining away from each other in directions away from the bottom portion 31.

In this box-packing apparatus 300, spreading of the bags B in the width direction can be regulated without attaching guides to regulate the width direction of the article groups B2.

(5) Example Modifications (5-1) Example Modification A

Although in the above embodiment the box-packing apparatus 300 includes multipole conveyance units 10 and multiple alignment units 20, it is not particularly limited to this. The box-packing apparatus 300 may include just one conveyance unit 10. Likewise, the box-packing apparatus 300 may include just one alignment unit 20.

When the box-packing apparatus 300 includes just one alignment unit 20, four article groups B2 are moved from the one alignment unit 20 to the accumulation unit 30. In other words, the box-packing apparatus 300 repeatedly moves an article group B2 from the alignment unit 20 to the accumulation unit 30 four times. At this time, the surfaces of the article groups B2 on the side pusher 33 side are inhibited by the side pusher 33 from spreading in front, rear, left, and right directions. However, the surfaces of the article groups B2 on the opposite side of the side pusher 33 are likely to spread forward, rearward, leftward, and rightward because there is nothing to inhibit them from spreading forward, rearward, leftward, and rightward. For that reason, the faster the article groups B2 are moved from the alignment unit 20 to the accumulation 30, the more likely it is that they will spread forward, rearward, leftward, and rightward. Furthermore, although forward and rearward spreading of the bags B is inhibited since the contact unit 40 is on the third conveyance route upstream side, there is nothing to inhibit spreading on the third conveyance route downstream side. For that reason, particularly the bags B that are on the third conveyance route downstream side of the first article group B2 are likely to spread in the shape of a fan.

Figure 16:
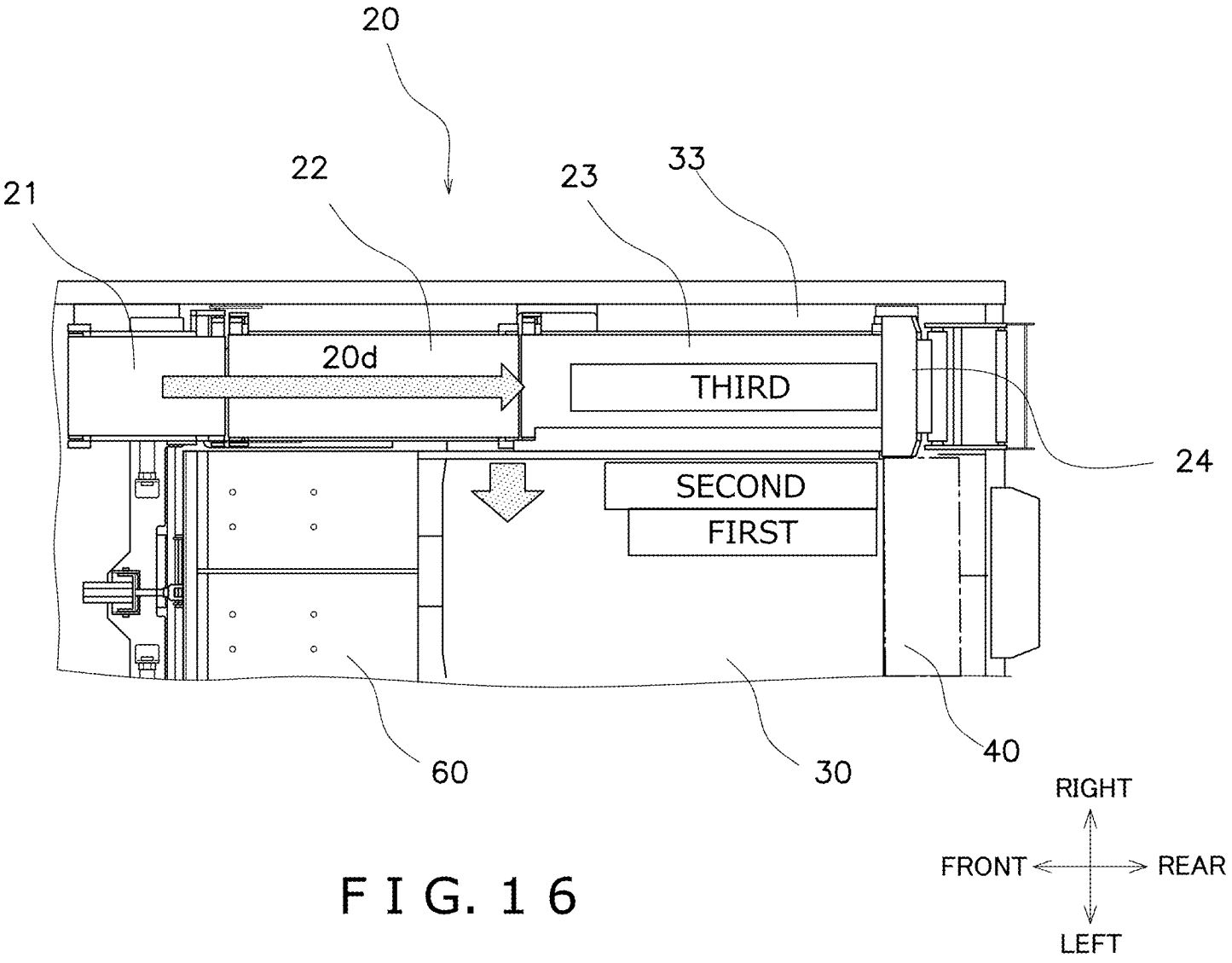
FIGS. 16 and 17 are schematic plan view which illustrate compression ratios in the alignment unit.
Figure 17:
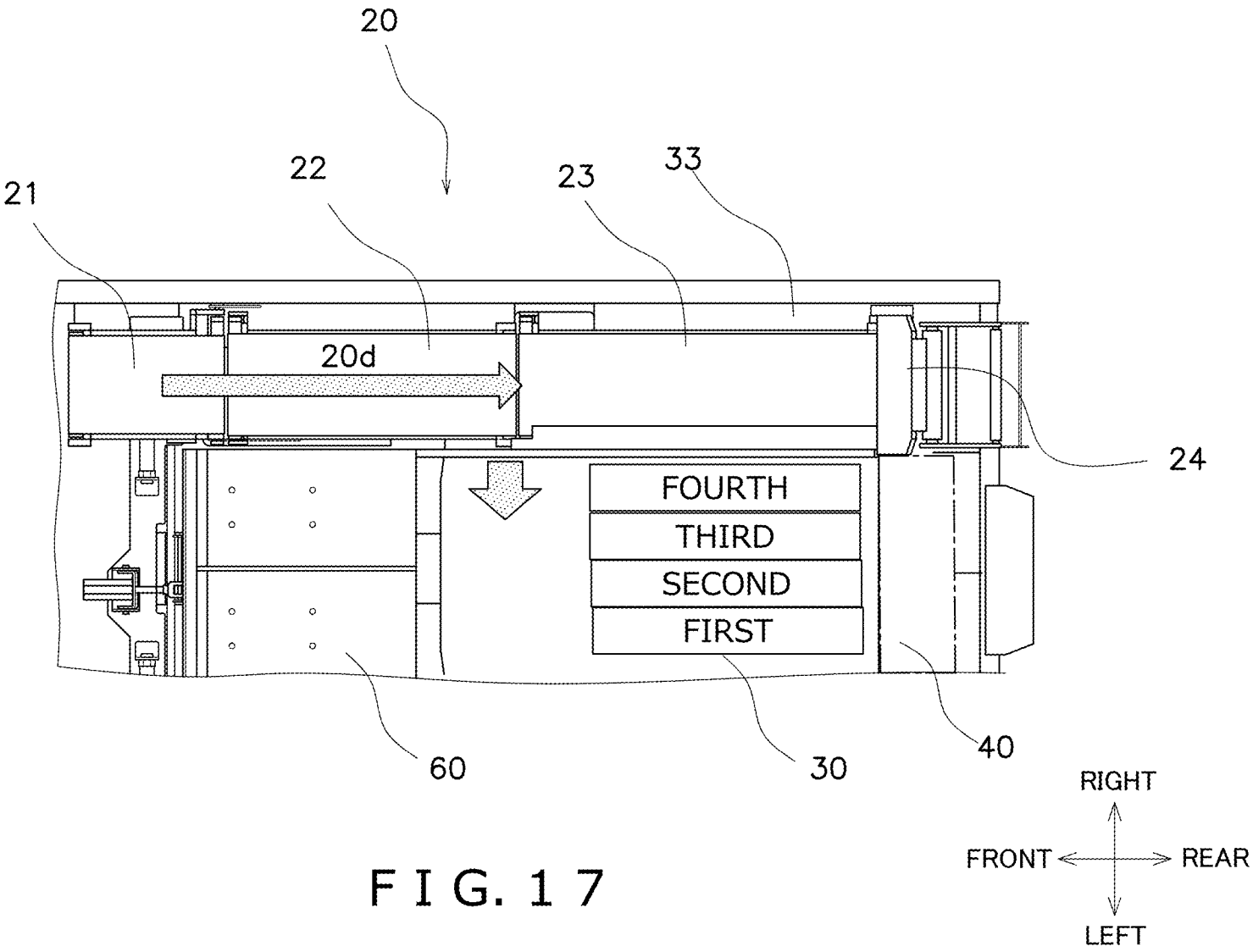

Thus, as described above, when it conveys the article groups B2 to the third alignment area 23, the alignment unit 20 makes the compression ratio of the second article group B2 lower than the compression ratio of the first article group B2. As shown in FIG. 16, the alignment unit 20 furthermore makes the compression ratio of the third article group B2 lower than the compression ratio of the second article group B2. The alignment unit 20 furthermore makes the compression ratio of the fourth article group B2 lower than the compression ratio of the third article group B2. In this way, when the side pusher 33 moves the article groups B2, as shown in FIG. 17, the first article group B2 can be prevented from spreading in the shape of a fan.

(5-2) Example Modification B

Although in the above embodiment the accumulation unit 30 has the bottom portion 31 and the two inclined surfaces 32, it is not particularly limited to this. The accumulation unit 30 may also be V-shaped as viewed from the front.

(5-3) Example Modification C

Although in the above embodiment the accumulation unit 30 accumulates multiple article groups B2, it is not particularly limited to this. The accumulation unit 30 may also accumulate just one article group B2.

(5-4) Example Modification D

In the above embodiment, the control unit 80 changes the angle formed by the contact surface of the contact unit 40 and a horizontal plane from the first angle A1 to the second angle A2 from when it starts moving the contact unit 40 to until it finishes moving the contact unit 40. However, the timing of the change from the first angle A1 to the second angle A2 is not particularly limited to this.

Figure 18:
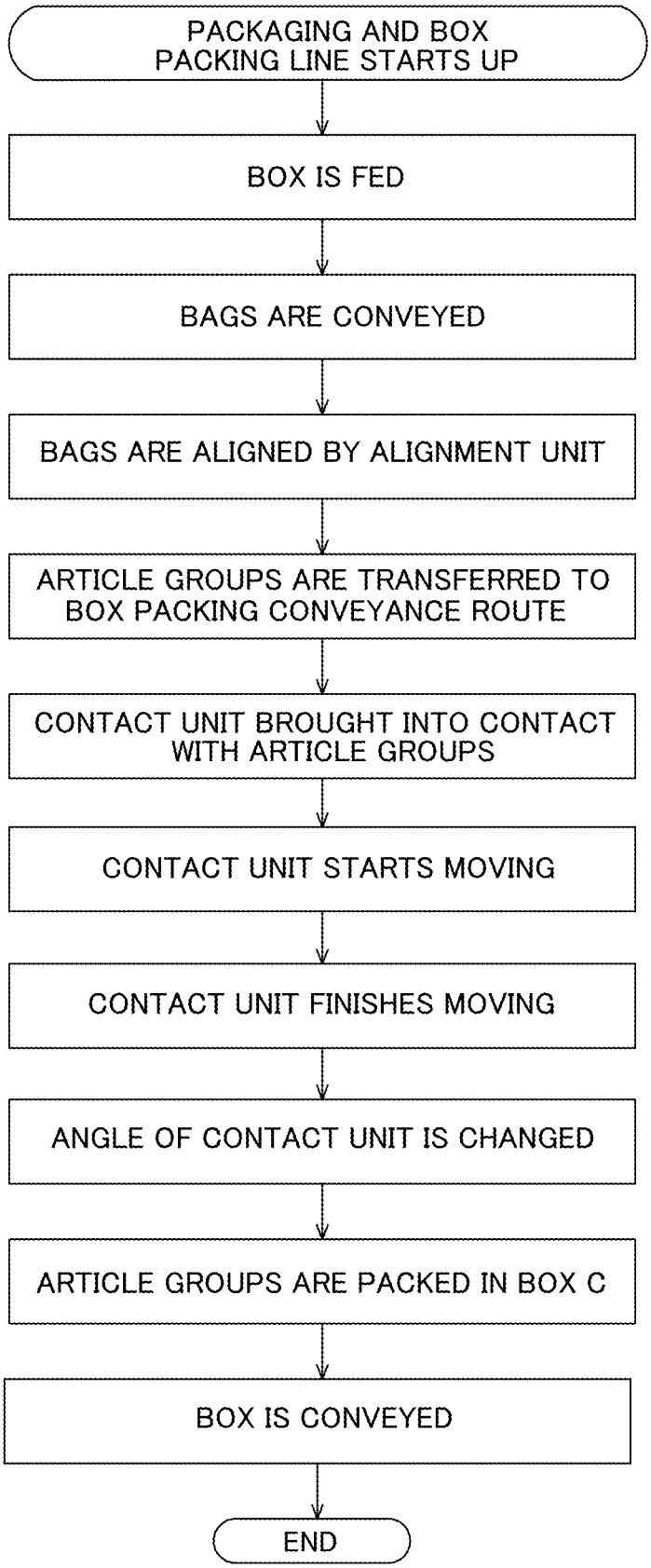
FIG. 18 is a flowchart of the box-packing operation in an exemplary modification.

For example, as shown in FIG. 18, the control unit 80 may change the angle formed by the contact surface of the contact unit 40 and a horizontal plane from the first angle A1 to the second angle A2 after it finishes moving the contact unit 40.

Figure 19:
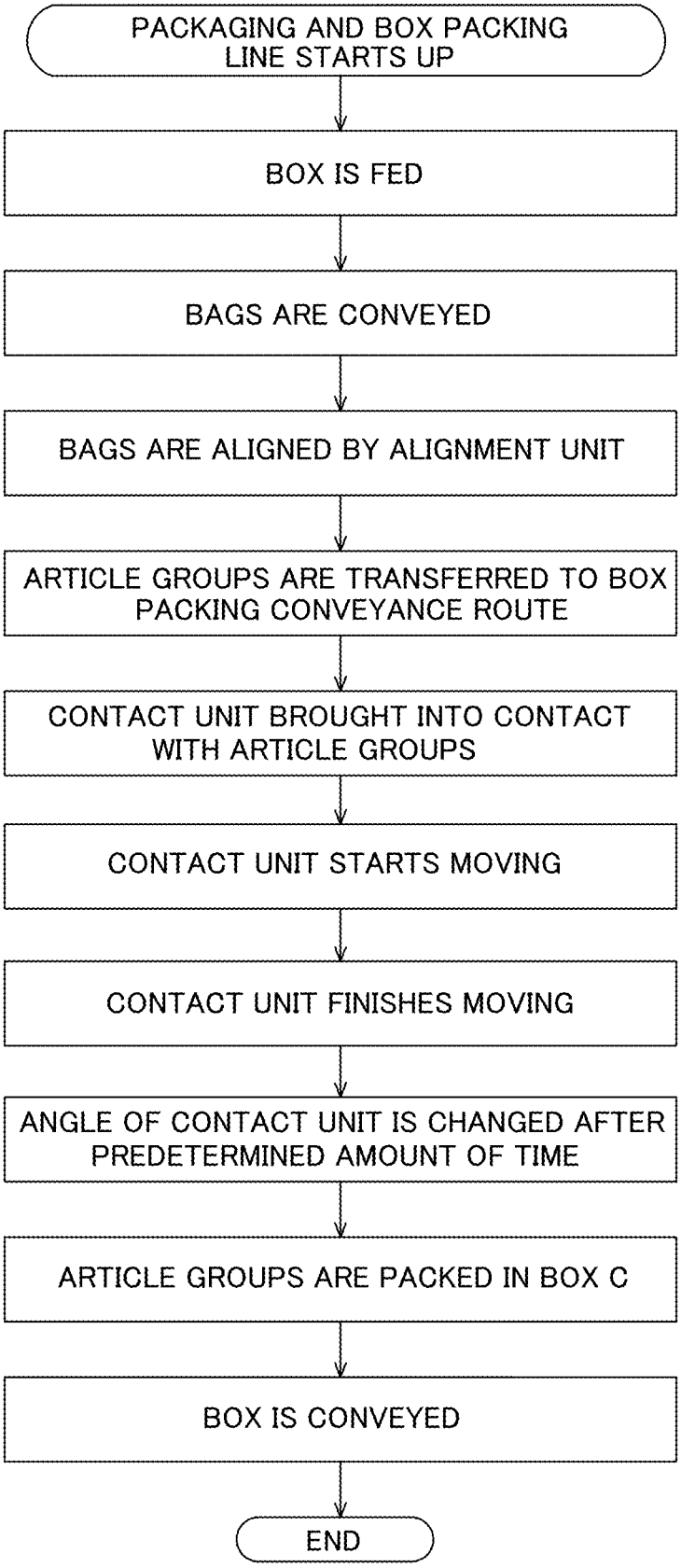
FIG. 19 is a flowchart of the box-packing operation in an exemplary modification.

Furthermore, as shown in FIG. 19, the control unit 80 may change the angle formed by the contact surface of the contact unit 40 and a horizontal plane from the first angle A1 to the second angle A2 after a predetermined amount of time after it finishes moving the contact unit 40.

The control unit 80 may change the angle formed by the contact surface of the contact unit 40 and a horizontal plane from the first angle A1 to the second angle A2 after the contact unit 40 has moved a predetermined distance after it finishes moving the contact unit 40.

(5-5) Example Modification E

Figure 20:
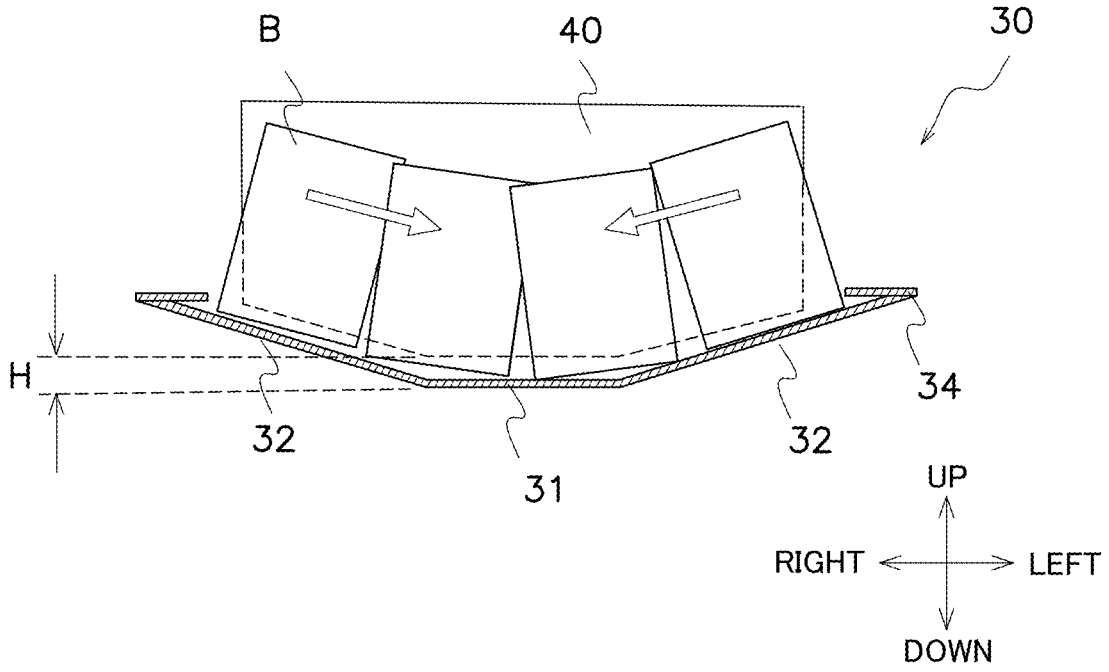
FIG. 20 is a schematic cross-sectional diagram of an exemplary modification of the accumulation unit as viewed from the front.

As shown in FIG. 20, the accumulation unit 30 may have regulating portions 34. The regulating portions 34 are tabular members extending along the third conveyance direction 30*d*. The regulating portions 34 are disposed one each on both the left and right sides of the accumulation unit 30 as viewed from the front. Specifically, the regulating portions 34 are disposed on the outer edge portions of the inclined surfaces 32. The regulating portions 34 are disposed in positions higher than the bottom surfaces of the bags B of the accumulated article group B3. The regulating portions 34 are disposed at the same height as the third alignment areas 23 of the alignment units 20. The regulating portions 34 regulate the bags B of the accumulated article group B3 from spreading in the left and right direction. When the article groups B2 have been laterally moved by the side pushers 33, the article groups B2 can cross over the regulating portions 34 and be accumulated by the accumulation unit 30. At the same time, the accumulated article group B3 does not return to the alignment units 20 because it is regulated on both left and right sides by the regulating portions 34.

REFERENCE SIGNS LIST

10: Conveyance Unit
20: Alignment Unit
30 Accumulation Unit
30*d*: Third Conveyance Direction
31: Bottom Portion
32: Inclined Surfaces
40 Contact Unit
50: Drive Unit
80 Control Unit
90: First Support Unit
91: Second Support Unit
93: Box Conveyance Unit
A1: First Angle
A2: Second Angle
B: Bags (Articles)
B2: Article Group
B3: Accumulated Article Group
R3: Third Conveyance Route

I claim:

1. A box-packing apparatus, comprising:
a conveyance unit that conveys articles;
an alignment unit that aligns the conveyed articles so that articles that are mutually adjacent partially overlap to thereby form an article group in a conveyance direction;
a transfer unit that transfers the article group to a box-packing conveyance route;
a contact unit that contacts the articles that are on a starting end side of the box-packing conveyance route in the transferred article group;
a drive unit that drives the contact unit in an alignment direction, the alignment direction being different than the conveyance direction; and
a control unit that controls the drive unit to move the contact unit in the alignment direction of the article group while pressing the article group in a state in which the contact unit is contacting and supporting the articles that are on the box-packing conveyance route starting end side and changes an angle formed by a contact surface of the contact unit and a horizontal plane from a first angle to a second angle larger than the first angle after the contact unit starts moving.

2. The box-packing apparatus of claim 1, wherein the control unit changes the angle formed by the contact surface of the contact unit and a horizontal plane from the first angle to the second angle from when it starts moving the contact unit to until it finishes moving the contact unit.

3. The box-packing apparatus of claim 1, wherein the control unit changes the angle formed by the contact surface of the contact unit and a horizontal plane from the first angle to the second angle after it finishes moving the contact unit.

4. The box-packing apparatus of claim 1, wherein the transfer unit moves the article group laterally in a direction perpendicular to the conveyance direction while maintaining its aligned state.

5. The box-packing apparatus of claim 1, comprising multiple alignment units and multiple conveyance units.

6. The box-packing apparatus of claim 1, wherein the transfer unit includes an accumulation unit that accumulates a plurality of the article groups such that they are parallel to each other on the box-packing conveyance route, and the accumulation unit has a bottom portion and two inclined surfaces that are disposed on both sides of the bottom portion as viewed from a front and that rise upward from the bottom portion while inclining away from each other in directions away from the bottom portion.

7. The box-packing apparatus of claim 1, wherein the alignment direction is in an opposite direction than the conveyance direction.

8. The box-packing apparatus of claim 1, wherein the alignment direction retraces the conveyance direction.

9. A box-packing apparatus comprising:

a conveyance unit that conveys articles;

an alignment unit that aligns the conveyed articles so that articles that are mutually adjacent partially overlap to thereby form an article group;

a transfer unit that transfers the article group to a box-packing conveyance route;

a contact unit that contacts the articles that are on a starting end side of the box-packing conveyance route in the transferred article group;

a drive unit that drives the contact unit; and a control unit that controls the drive unit to move the contact unit in an alignment direction of the article group in a state in which the contact unit is contacting and supporting the articles that are on the box-packing conveyance route starting end side and changes an angle formed by a contact surface of the contact unit and a horizontal plane from a first angle to a second angle larger than the first angle after the contact unit starts moving, wherein the control unit changes the angle formed by the contact surface of the contact unit and a horizontal plane from the first angle to the second angle after a predetermined amount of time after it finishes moving the contact unit.

* * * * *